US009217602B2

(12) United States Patent
Lee et al.

(10) Patent No.: US 9,217,602 B2
(45) Date of Patent: Dec. 22, 2015

(54) REFRIGERATOR

(71) Applicant: LG ELECTRONICS INC., Seoul (KR)

(72) Inventors: Daesung Lee, Seoul (KR); Seonkyu Kim, Seoul (KR); Soomin Seo, Seoul (KR); Woonkyu Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/174,714

(22) Filed: Feb. 6, 2014

(65) Prior Publication Data

US 2014/0252937 A1 Sep. 11, 2014

(30) Foreign Application Priority Data

Mar. 5, 2013 (KR) ..... 10-2013-0023159

(51) Int. Cl.
*F25D 25/02* (2006.01)

(52) U.S. Cl.
CPC ..... *F25D 25/02* (2013.01)

(58) Field of Classification Search
CPC ..... F25D 25/024
USPC ..... 312/215, 222, 301, 334.14, 334.15, 312/334.27, 334.32, 334.33, 334.36, 312/334.37, 334.39, 404, 405.1, 408, 410; 108/102, 108, 137, 143
See application file for complete search history.

(56) References Cited

U.S. PATENT DOCUMENTS

| | | | | |
|---|---|---|---|---|
| 2,599,240 | A * | 6/1952 | Ellerson | 312/334.7 |
| 5,329,865 | A * | 7/1994 | McWard | 109/50 |
| 7,766,437 | B2 * | 8/2010 | Lim et al. | 312/408 |
| 7,950,756 | B2 * | 5/2011 | Collins et al. | 312/408 |
| 2012/0267993 | A1 * | 10/2012 | Moon et al. | 312/408 |

* cited by examiner

*Primary Examiner* — Matthew Ing
(74) *Attorney, Agent, or Firm* — Ked & Associates, LLP

(57) ABSTRACT

A refrigerator may include a main body, a storage chamber provided within the main body, a drawer assembly provided in the lower portion of the storage chamber, a cover shelf covering at least a part of the upper surface of the drawer assembly, a lower shelf disposed between the cover shelf and the sidewall of the storage chamber and provided with one side supported by the sidewall of the storage chamber so as to be pulled out and the other side supported by the upper surface of the drawer assembly so as to be pulled out, and an upper shelf disposed above the lower shelf and provided with one side supported by the sidewall of the storage chamber so as to be pulled out and the other side supported by a shelf frame mounted on the rear wall of the storage chamber so as to be pulled out.

13 Claims, 18 Drawing Sheets

(a)

(b)

REFRIGERATOR

This application claims the benefit of Korean Patent Application No. 10-2013-0023159, filed on Mar. 5, 2013, which is hereby incorporated by reference as if fully set forth herein.

BACKGROUND OF THE INVENTION

1. Field of the Invention

The present invention relates to a refrigerator, and more particularly, to a refrigerator having a shelf mounted at one side of a storage chamber so as to be pulled out.

2. Discussion of the Related Art

In general, a refrigerator is an apparatus which stores food in a frozen state or in a refrigerated state by lowering the temperature of a storage chamber by discharging cool air, generated by a refrigerating cycle consisting of a compressor, a condenser, an expansion valve, and an evaporator.

The refrigerator generally includes a freezing chamber storing food and drinks in a frozen state and a refrigerating chamber storing food and drinks at a low temperature. Further, a Kimchi refrigerator to store food, such as Kimchi, or vegetables in a fresh state is a kind of refrigerator.

At least one of a plurality of doors installed on the refrigerator is connected to one side of a main body of the refrigerator by a hinge and is rotated so as to open and close to a front surface of the main body. In addition to the door rotated by the hinge, a drawer type door mounted on a front surface of a drawer and pulled out and inserted in the forward and backward directions together with the drawer may be used.

In order to accommodate various sizes of food and to increase space utilization, the freezing chamber and the refrigerating chamber of the refrigerator are provided with a plurality of shelves dividing freezing chamber and the refrigerating chamber into upper and lower spaces.

Further, the refrigerating chamber is generally provided with a vegetable room to store vegetables and fruits separately from other spaces of the refrigerator chamber.

The vegetable room is formed as a drawer, and an upper open part of the drawer-type vegetable room is closed by a shelf.

Further, a closed drawer may be provided in the freezing chamber, and a shelf may be provided on the closed drawer so that a storage space within the drawer may be closed by the shelf.

However, as refrigerators recently tend to increase in size, the length of the storage chambers in the forward and backward directions increases. In this case, a user is difficult to take an article out of the rear portion of a shelf.

Particularly, if many articles are accommodated on the shelf, it is more difficult to take an article out of the rear portion of the shelf.

Therefore, a shelf configured so as to be pulled out under the condition that articles are mounted on the shelf has been developed.

SUMMARY OF THE INVENTION

Accordingly, the present invention is directed to a refrigerator that substantially obviates one or more problems due to limitations and disadvantages of the related art.

An object of the present invention is to provide a refrigerator having a shelf which may be disposed adjacent to one side of a storage chamber and be pulled out in the forward and backward directions.

Another object of the present invention is to provide a refrigerator having a shelf, both sides of which are slidably supported so that the shelf may be smoothly pulled out under the condition that heavy stored articles are placed on the shelf.

A further object of the present invention is to provide a refrigerator having a lower shelf and an upper shelf respectively provided so as to be pulled out and a rotary shelf provided between the upper shelf and the lower shelf to effectively use a space between the upper shelf and the lower shelf.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a main body, a storage chamber provided within the main body, a cantilever bracket mounted on the rear wall of the storage chamber and including at least one slit, a shelf frame mounted on the cantilever bracket by inserting a hook, provided at the rear end of the shelf frame, into the at least one slit, including a guide part formed on the upper surface thereof, and formed of a metal, a fixed rail mounted on the sidewall of the storage chamber, and a shelf including a guide groove formed on the lower surface of one side thereof and slidably supported by the guide part of the shelf frame and a moving rail combined with the other side thereof and guided by the fixed rail.

In another aspect of the present invention, a refrigerator includes a main body, a storage chamber provided within the main body, drawers provided in the lower portion of the storage chamber so as to be pulled out, a cover mounted on the upper surfaces of the drawers so as to cover the upper surfaces of the drawers, a fixed rail mounted on the sidewall of the storage chamber, rollers provided in mounting slots formed on the upper surface of the cover, and a shelf including a guide groove formed on the lower surface of one side thereof and supported by the rollers, and a moving rail combined with the other side thereof and guided by the fixed rail.

In another aspect of the present invention, a refrigerator includes a main body, a storage chamber provided within the main body, a pair of cantilever brackets mounted on the rear wall of the storage chamber and including a plurality of slits arranged in the vertical direction, a pair of shelf frames mounted on the pair of cantilever brackets by inserting hooks, provided at the rear ends of the pair of shelf frames, into the plurality of slits, including a horizontal part formed on the upper surface of each of the pair of shelf frames, and formed of a metal, a pair of guide rails respectively supported by the pair of shelf frames, at least one slider slidably mounted on each of the pair of guide rails, and a shelf supported so as to be pulled out in the forward and backward directions with respect to the pair of shelf frames by combining each of the lower portions of both sides of the shelf with the at least one slider.

In another aspect of the present invention, a refrigerator includes a main body, a storage chamber provided within the main body, drawers provided in the lower portion of the storage chamber so as to be pulled out, a cover mounted on the upper surfaces of the drawers so as to cover the upper surfaces of the drawers, a pair of guide rails mounted at the left and right sides of the upper surface of the cover, at least one slider slidably mounted on each of the pair of guide rails, and a shelf supported so as to be pulled out in the forward and backward directions with respect to the cover by combining each of the lower portions of both sides of the shelf with the at least one slider.

In yet another aspect of the present invention, a refrigerator includes a main body, a storage chamber provided within the main body, drawers provided in the lower portion of the storage chamber, a cover mounted on the upper surfaces of the drawers so as to cover the upper surfaces of the drawers, a lower shelf mounted on the cover, both sides of the lower shelf being supported so as to be pulled out, an upper shelf disposed above the lower shelf, both sides of the upper shelf being supported so as to be pulled out, and connection bars connecting one side of the lower shelf and one side of the upper shelf so that the lower shelf and the upper shelf may be simultaneously pulled out.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
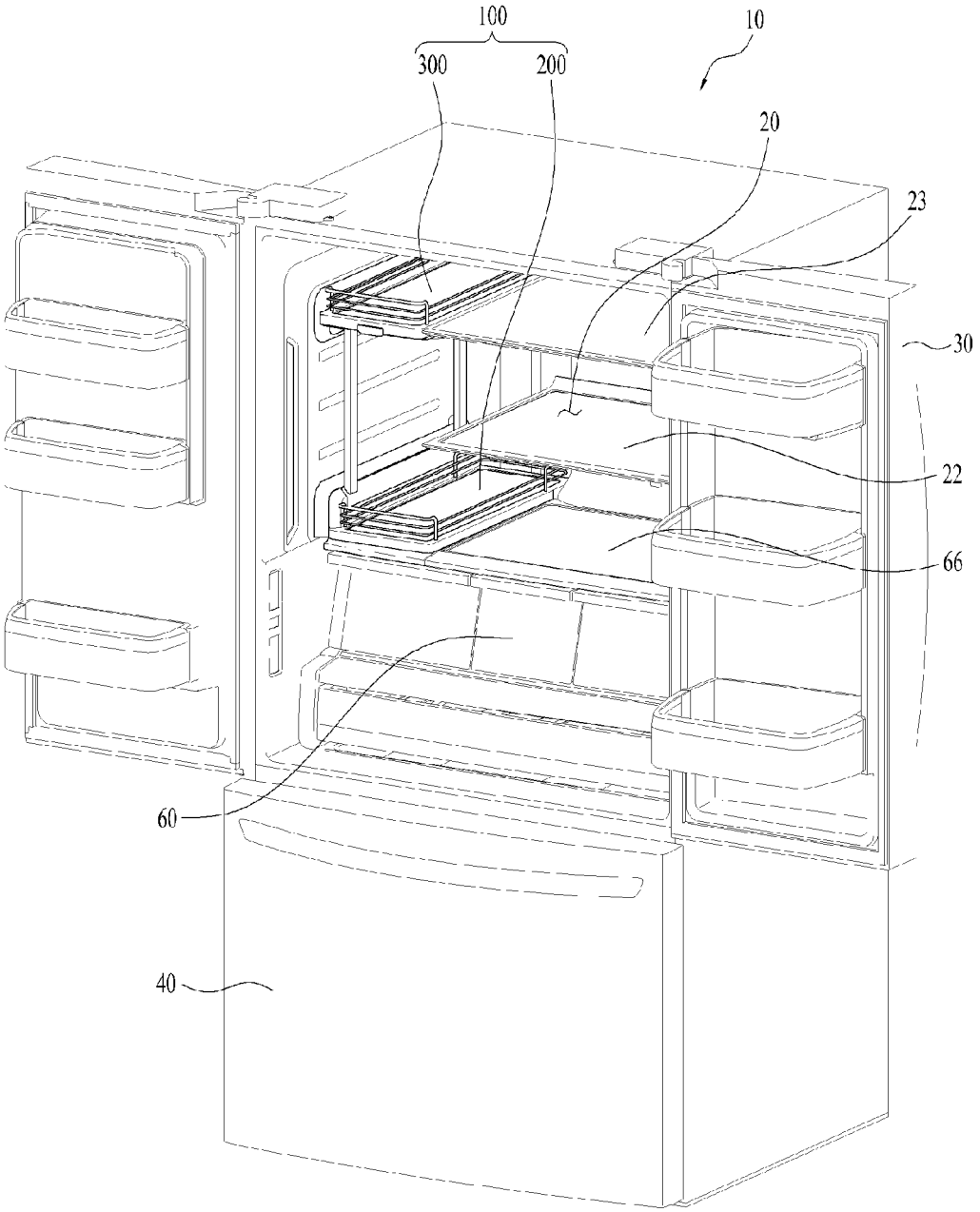
FIG. 1 is a perspective view illustrating the overall external appearance of a refrigerator in accordance with one embodiment of the present invention.

FIG. 1 is a perspective view illustrating the overall external appearance of a refrigerator in accordance with one embodiment of the present invention.

The refrigerator of the present invention includes a refrigerating chamber 20 and a freezing chamber as storage chambers within a main body 10.

The refrigerator is a bottom freezer type refrigerator, in which the refrigerating chamber 20 is disposed above the freezing chamber.

However, the disclosure is not limited to such a refrigerator and may be applied to a side by side type refrigerator, in which a freezing chamber and a refrigerating chamber are disposed side by side, or a top mounting type refrigerator, in which a freezing chamber is disposed above a refrigerating chamber.

A pair of doors 30 opening and closing the refrigerating chamber 20 may be rotatably mounted at both sides of the main body.

A door 40 opening and closing the freezing chamber is a drawer type door.

Of course, the shapes of the doors 30 and 40 may be variously designed according to disposition of the refrigerating chamber 20 and the freezing chamber or disposition of storage spaces therein.

In general, a drawer assembly 60 provided so as to be pulled out is mounted in the lower portion of the refrigerating chamber 20.

A shelf 66 covering the upper surface of the drawer assembly 60 while supporting stored articles is provided on the drawer assembly 60.

The shelf 66 serves to cover the upper surface of the drawer assembly 60 and to support the stored articles placed on the upper surface of the shelf 66 and thus, may be referred to as a cover shelf 66.

One or more shelves 22 and 23 may be provided above the shelf 66 at designated heights. In FIG. 1, a first shelf 22 is provided above the cover shelf 66, and a second shelf 23 is provided above the first shelf 22.

The cover shelf 66 is not configured so as to cover the entirety of the upper surface of the drawer assembly 60 but is configured so as to cover a part of the upper surface of the drawer assembly 60. For example, the cover shelf 66 has a designated width so as to cover the right portion of the upper surface of the drawer assembly 60.

The first shelf 22 and the second shelf 23 are mounted in the right portion of the refrigerating chamber 20 in the same manner as the cover shelf 66. Thus, a space in which the first shelf 22 and the second shelf 23 are not located is provided at the left space of the refrigerator chamber 20 above the drawer assembly 60.

A shelf assembly 100 including a lower shelf 200 and an upper shelf 300 is provided in the left space of the refrigerator chamber 20.

Although, the disclosure describes the shelf assembly 100 as being disposed at the left portion of the refrigerating chamber 20, the shelf assembly 100 may be disposed at the right portion of the refrigerating chamber 20 and be disposed also in the freezing chamber.

Hereinafter, with reference to FIGS. 2 to 10(*c*), configuration and operation of the shelf assembly in accordance with this embodiment of the present invention will be described in detail.

Figure 2:
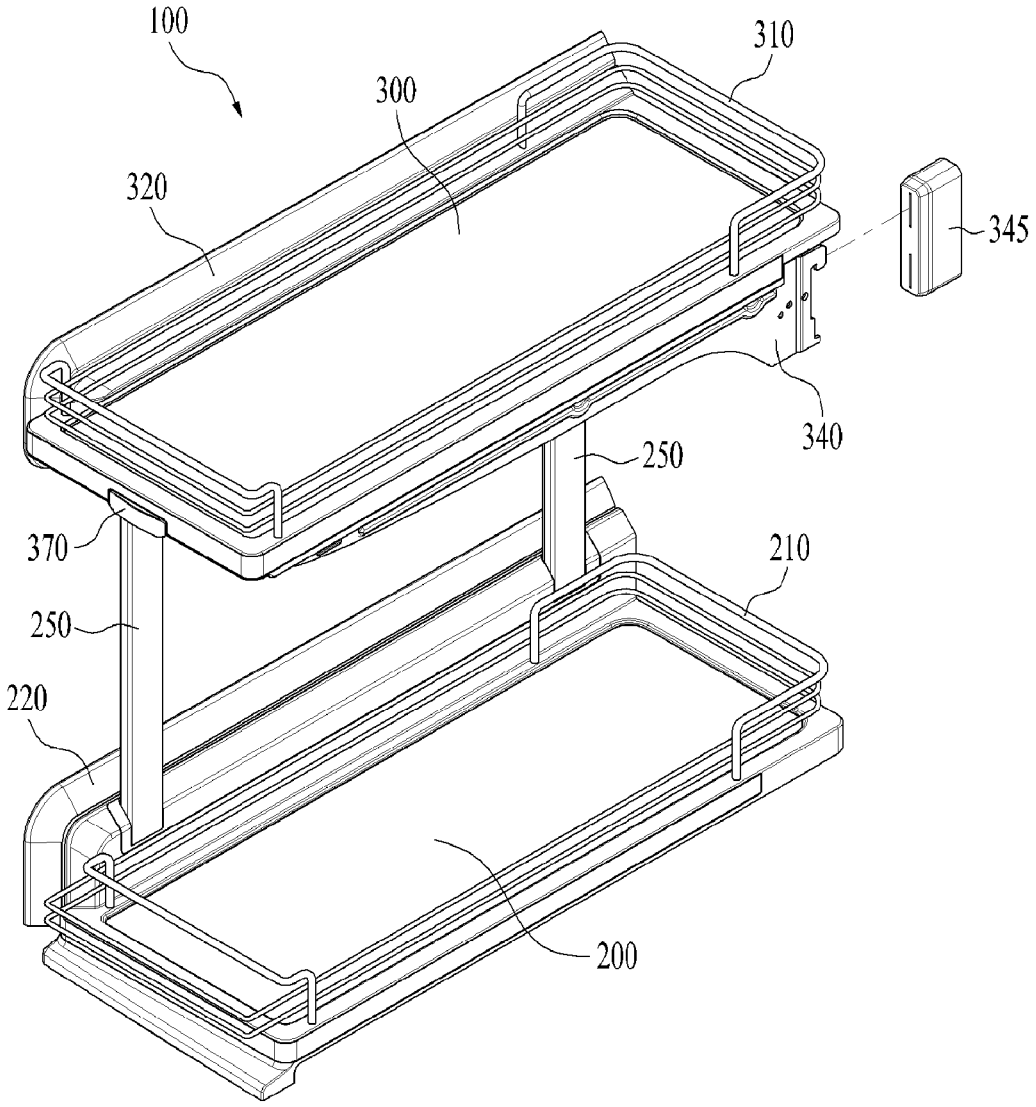
FIG. 2 is a perspective view illustrating the external appearance of a shelf assembly of FIG. 1.

As exemplarily shown in FIG. 2, the lower shelf 200 and the upper shelf 300 have a structure in which the left and right sides of each of the lower shelf 200 and the upper shelf 300 are supported so as to be pulled out.

In this embodiment, the lower shelf 200 and the upper shelf 300 are respectively supported by rail assemblies 220 and 320 provided at the left sides of the lower shelf 200 and the upper shelf 300.

The lower shelf 200 is provided so as to be slidable on the drawer assembly 60, and the right side of the lower shelf 200 is supported by the upper surface of the drawer assembly 60.

The right side of the upper shelf 300 is slidably supported by a shelf frame 340, the rear end of which is inserted into a cantilever bracket 345 provided on the rear wall of the refrigerating chamber 20.

At least one slit, into which a mounting protrusion formed at the rear end of the shelf frame 340 is inserted, is formed on the cantilever bracket 345.

The shelf frame 340 supporting the left side of the second shelf 23 if the second shelf 23 is mounted at the same height as the upper shelf 300 may be mounted on the cantilever bracket 345.

The lower shelf 200 and the upper shelf 300 may be connected by connection bars 250 vertically provided between the left sides of the lower shelf 200 and the upper shelf 300.

Such connection bars 250 connect the lower shelf 200 and the upper shelf 300 so that the lower shelf 200 and the upper shelf 300 may move together, and are provided adjacent to the sidewall of the refrigerating chamber 20.

Although the disclosure describes two connection bars 250 installed in front and rear regions between the left sides of the lower shelf 200 and the upper shelf 30, the number of the connection bars 250 is not limited thereto.

The connection bars 250 are combined with the left side of the shelf assembly 100 and may thus minimize interference occurring when a stored article to be accommodated is put into or taken out of the lower shelf 200.

Figure 3:
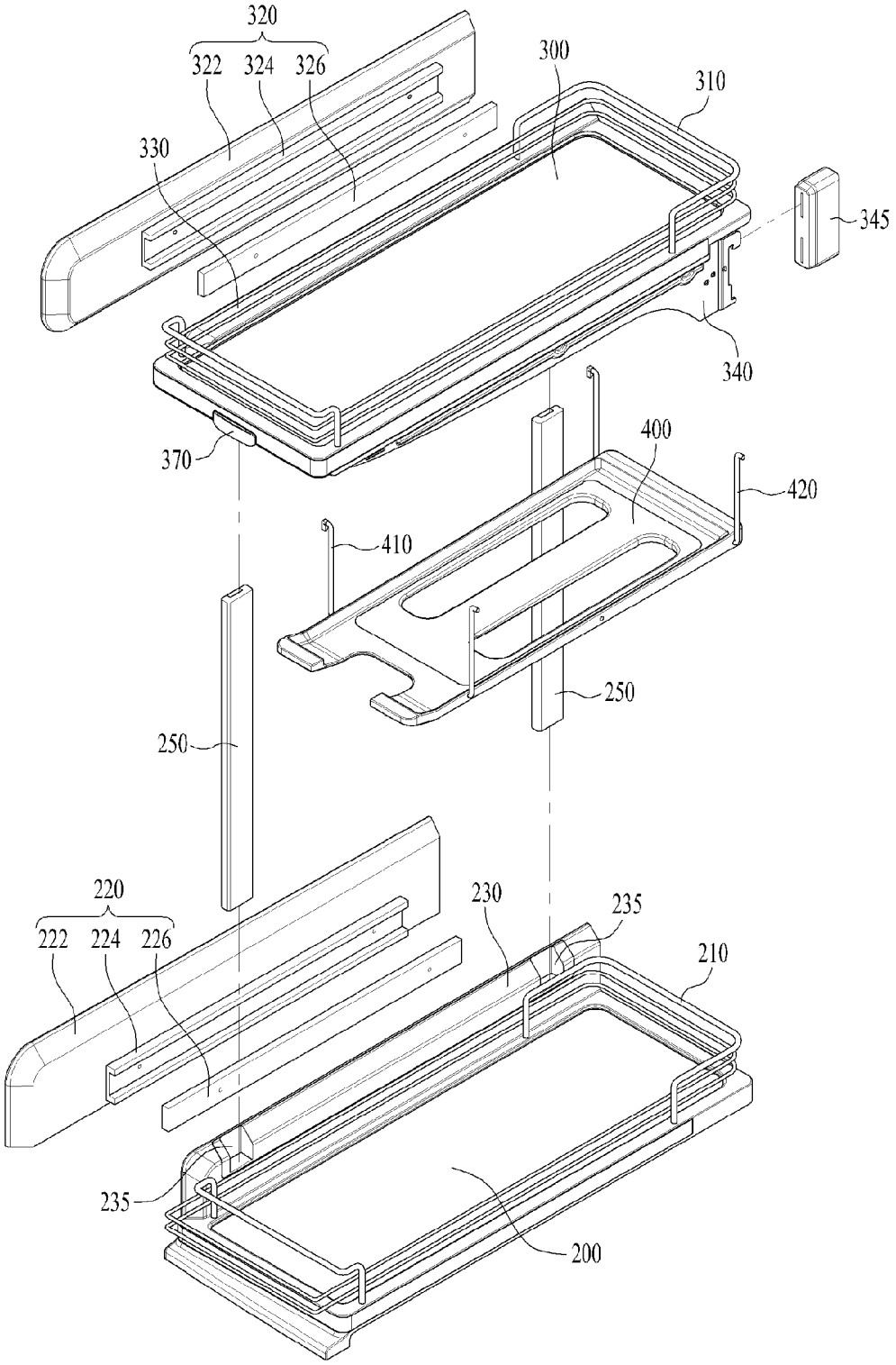
FIG. 3 is an exploded perspective view of the shelf assembly of FIG. 2.

As exemplarily shown in FIG. 3, the connection bars 250 may be detachably provided between the lower shelf 200 and the upper shelf 300.

If the connection bars 250 installed between the lower shelf 200 and the upper shelf 300 are connected to the lower shelf 200 and the upper shelf 300, when a user moves the shelf assembly 100, the lower shelf 200 and the upper shelf 300 may be simultaneously moved.

On the other hand, if the connection bars 250 are separated from the lower shelf 200 and the upper shelf 300, the user may move the lower shelf 200 and the upper shelf 300 independently.

A detailed example of the attachment and detachment structure of the connection bars 250 will be described later.

The lower shelf 200 and the upper shelf 300 may further include wall parts 210 and 310 installed at the edges of the upper surfaces thereof.

The wall parts 210 and 310 are formed of a wire of a designated diameter and prevent stored articles accommodated on the lower shelf 200 and the upper shelf 300 from falling to the outside of the lower shelf 200 and the upper shelf 300.

The wall parts 210 and 310 are not limited to the above-described shape, and may be provided in a panel shape extending upward from the edge of each of the lower shelf 200 and the upper shelf 300.

Figure 4:
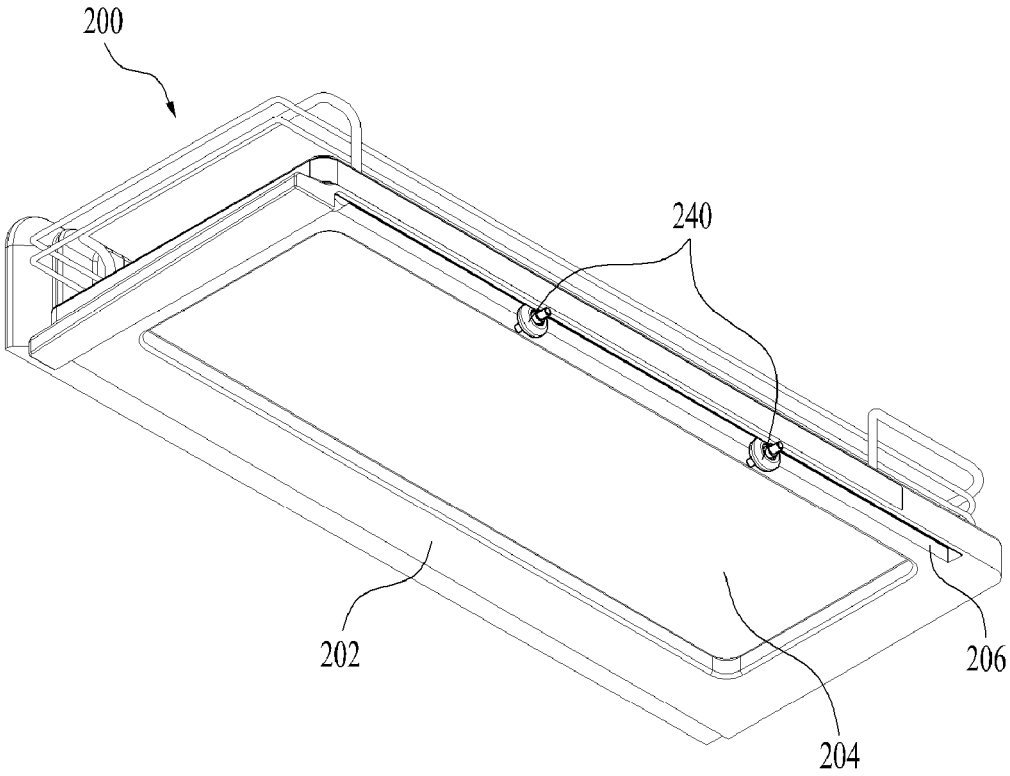
FIG. 4 is a perspective view illustrating support of the lower portion of one side of a lower shelf by rollers.
Figure 5:
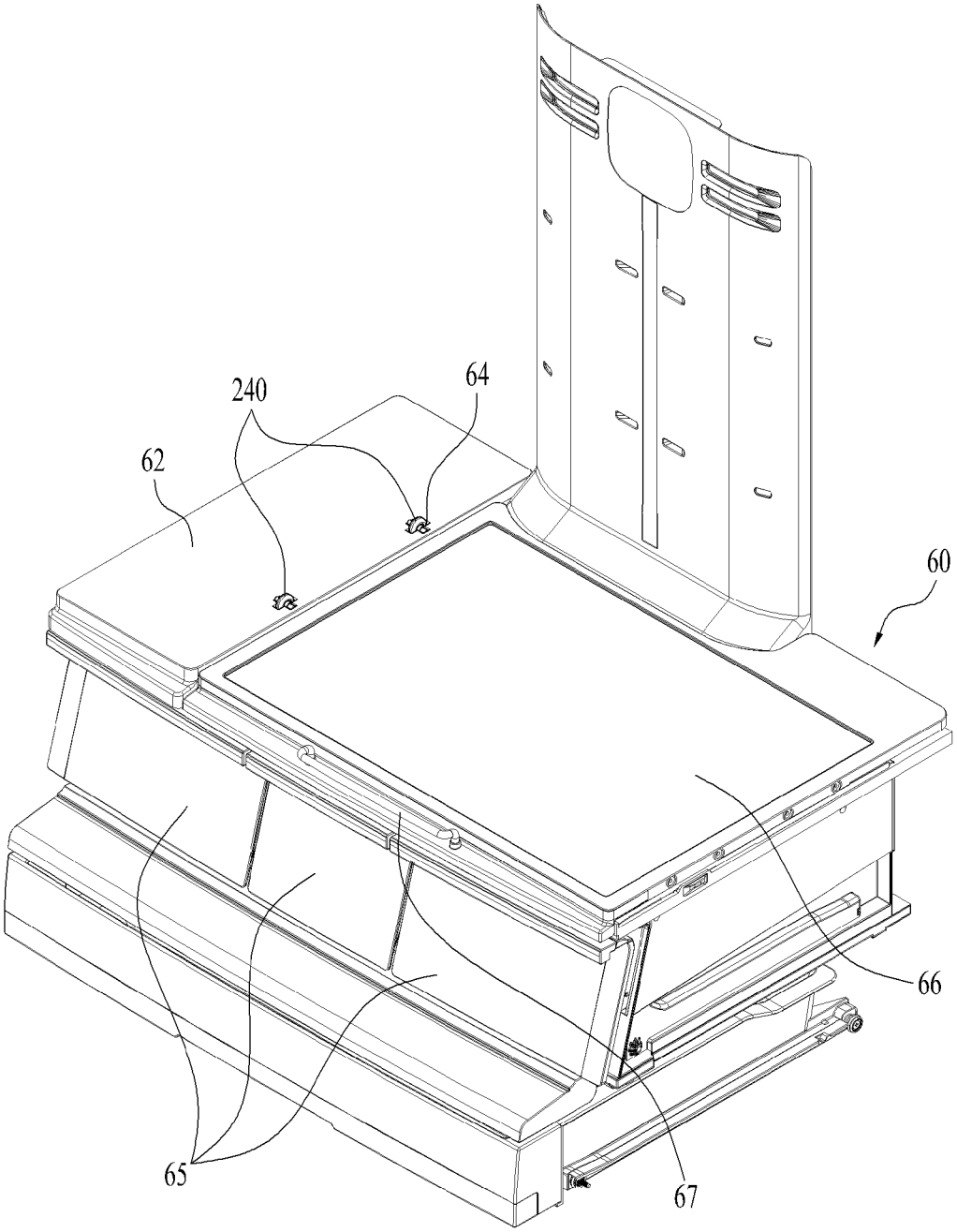
FIG. 5 is a perspective view illustrating mounting of the rollers shown in FIG. 4 on a cover of the shelf assembly.

One side of the lower shelf 200 is supported by the rail assembly 220 mounted on the inner wall of the storage chamber so as to be pulled out, as exemplarily shown in FIG. 3, and the other side of the lower shelf 200 is supported by a plurality of rollers 240 mounted on a cover 62 covering the upper surface of the drawer assembly 60 so as to be pulled out, as exemplarily shown in FIGS. 4 and 5.

As exemplarily shown in FIG. 3, the lower shelf 200 may be disposed at the left portion of the refrigerating chamber 20. Here, the rail assembly 220 is installed such that one side of the rail assembly 220 is fixed to the left wall of the refrigerating chamber 20 and the other side of the rail assembly 220 is movable in the forward and backward directions.

The rail assembly 220 includes a fixed rail 224 installed on the left wall of the refrigerating chamber 20 and a moving rail 226 supported so as to be slidable with respect to the fixed rail 224.

Although the fixed rail 224 may be fixed directly to the left wall of the refrigerating chamber 20, the fixed rail 224 may be fixed to a fixing frame 222 installed on the sidewall of the refrigerating chamber 20.

The moving rail 226 may be fixed to a moving rail coupling part 230 fixed to the left surface of the lower shelf 220 rather than fixed directly to the left side of the lower shelf 220.

Here, the fixing frame 222 and the moving rail coupling part 230 may have shapes corresponding to each other, and the fixed rail 224 and the moving rail 226 are accommodated between the fixing frame 222 and the moving rail coupling part 230 so that the fixed rail 224 and the moving rail 226 are not visible from the outside when the fixing frame 222 and the moving rail coupling part 230 overlap each other.

As exemplarily shown in FIG. 4, a guide groove 206, into which the outer circumferences of the plural rollers 240 are inserted so as to be supported, may be formed on the lower surface of the right portion of a frame part 202 of the lower shelf 200.

As exemplarily shown in FIG. 5, the drawer assembly 60 may include the cover 62 mounted at the left portion of the refrigerating chamber 20 where the lower shelf 600 is disposed, so as to cover a part of a left drawer 65 among a plurality of drawers 65.

The plural rollers 240 are rotatably mounted in roller mounting slots 64 formed at the right portion of the cover 62.

In FIG. 5, two rollers 240 are disposed at the right portion of the cover 62 in the forward and backward directions. Even if the lower shelf 200 is maximally pulled out, the plural rollers 240 should maintain a supporting state of the lower shelf 200. Therefore, among the plural rollers 240, the rearmost roller 240 may be disposed at a position separated from the rear end of the cover 62 by a distance of ⅓ or more of the length of the cover 62 in the forward and backward directions.

Although the lower shelf 200 may slide in direct contact with the upper surface of the cover 62 of the drawer assembly 60, the plural rollers 240 and the guide groove 206 may reduce friction between the lower shelf 200 and the upper surface of the cover 62 when the lower shelf 200 is pulled out and thus, allow the lower shelf 200 to be more smoothly pulled out.

It may be understood that FIG. 4 illustrates insertion of the plural rollers 240 shown in FIG. 5 into the guide groove 206.

Further, as exemplarily shown in FIG. 5, the drawer assembly 60 may include two or more drawers 65, and the plural drawers 65 may be disposed side by side or be stacked in a two-layer structure.

Further, the cover shelf 66 installed on the upper surfaces of the drawers 65 may be provided so as to be pulled out in the forward and backward directions. Therefore, in FIG. 5, a handle 67 may be provided on the upper portion of a front surface of the cover shelf 66 so that a user may withdraw the cover shelf 66 by hand.

Further, as exemplarily shown in FIGS. 3 and 5, the front end of the lower shelf 200 may protrude more forward than the front end of the cover 62 and extend downward so as to cover a front surface of the cover 62.

The front end of the lower shelf 200 may protrude forward not only to completely cover the cover 62 thereunder but also to be coplanar with a front surfaces of handle parts of the drawers 65.

Further, the front end of the lower shelf 200 extends downward and thus forms a stepped part covering the front surface of the cover 62. The stepped part may serve as a stopper locked to the front surface of the cover 62 when the lower shelf 200 is pulled out from the refrigerating chamber 20 and then inserted into the refrigerating chamber 20.

Referring to FIG. 3 again, the left side of the upper shelf 300 may be supported by the rail assembly 320 mounted on the inner wall of the storage chamber so as to be pulled out, in the same manner as the lower shelf 200, and the right side of the upper shelf 300 may be supported so as to be slidable with respect to the shelf frame 340 supported by the cantilever bracket 345 mounted on the rear wall of the storage chamber.

The rail assembly 320 includes a fixing frame 322 installed on the left wall of the refrigerating chamber 20, a fixed rail 324 fixed to the fixing frame 322, a moving rail 326 supported so as to be slidable with respect to the fixed rail 324, and a moving rail coupling part 330 fixed to the left surface of the upper shelf 300 so that the moving rail 326 is fixed to the moving rail coupling part 330.

Although the two rail assemblies 220 and 320 are described as having a 2-stage rail structure, the rail assemblies 220 and 320 may have a 3-stage rail structure further including an intermediate rail between a fixed rail and a moving rail.

If a 3-stage rail structure is employed, a withdrawal distance may increase, as compared to a 2-stage rail structure.

As exemplarily shown in FIG. 3, the lower ends of the connection bars 250 may be selectively inserted into mounting slots 235 formed on the moving rail coupling part 230.

Figure 7:
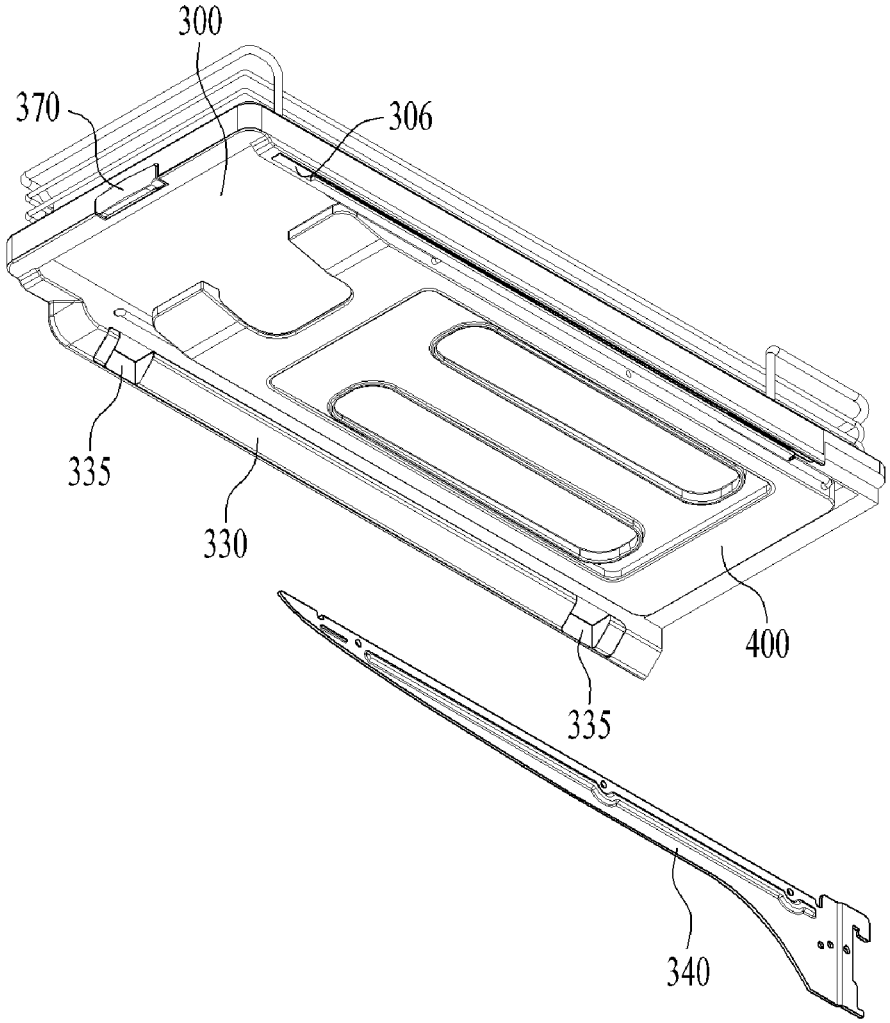
FIG. 7 is a perspective view of FIG. 6, as seen from the bottom.

Further, as exemplarily shown in FIG. 7, the upper ends of the connection bars 250 may be inserted into mounting slots 335 formed on the moving rail coupling part 330 of the upper shelf 300.

Further, the connection bars 250 may not be provided so as to be installed always between the two mounting slots 235 and 335, but may be provided so as to be detachably attached to the two mounting slots 235 and 335.

Figure 8:
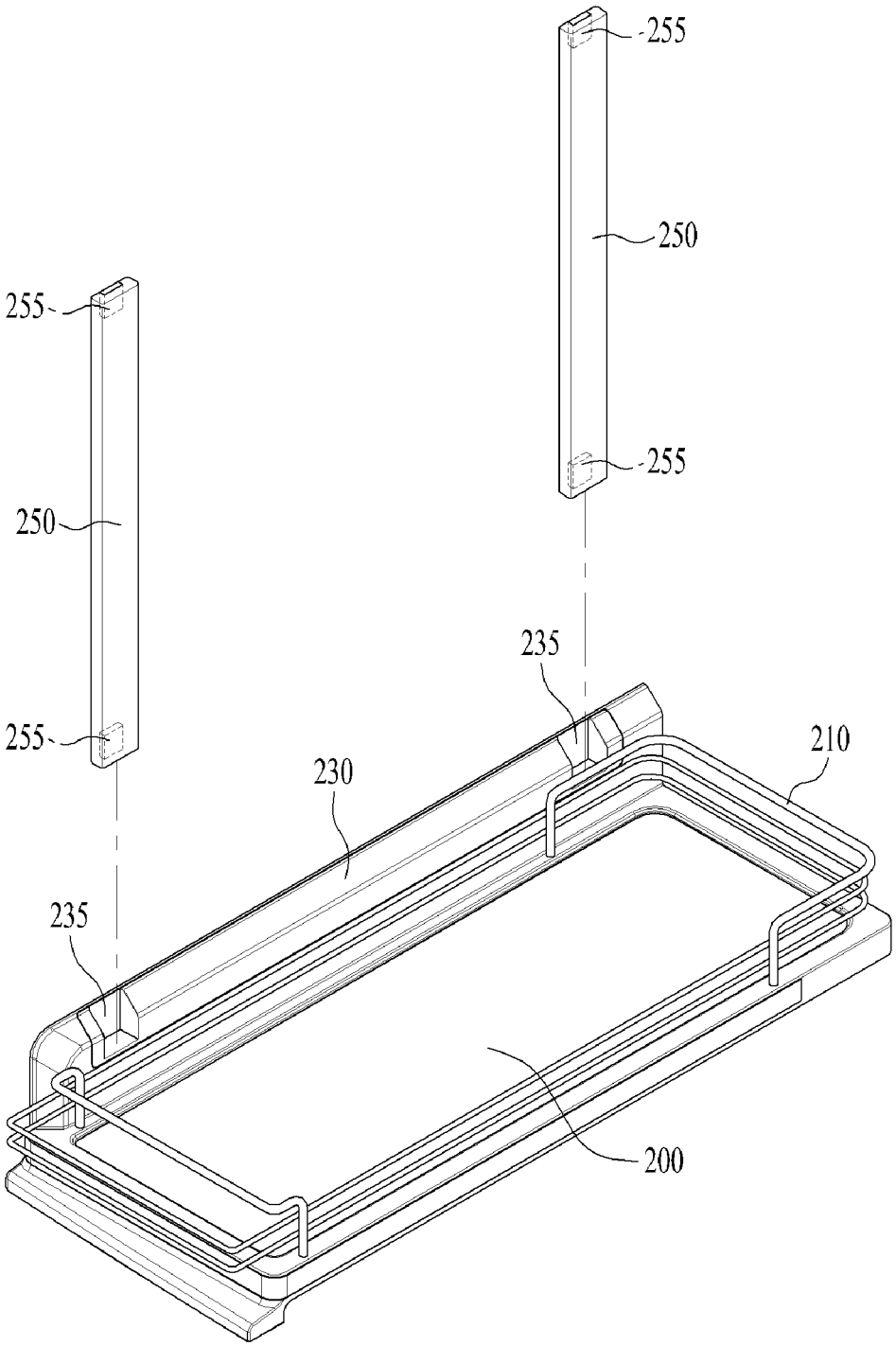
FIG. 8 is an exploded perspective view illustrating combination of a pair of connection bars with one side of the lower shelf.

For this purpose, as exemplarily shown in FIG. 8, magnets 255 are provided in the upper and lower ends of the connection bars 250, and at least contact parts of the mounting slots 235 and 335 with the connection bars 250 may be formed of a metal generating attractive force with the magnets 255.

The mounting slots 235 and 335 may have a shape corresponding to the cross-sectional shape of the connection bars 250. Further, the mounting slots 235 and 335 may have a shape provided with opened side and upper surfaces and closed front and rear surfaces.

Thereby, the connection bars 250 may be easily inserted into the mounting slots 235 and 335 in the sideward direction and be fixed in the forward and backward directions.

The lower shelf 200, as exemplarily shown in FIG. 4, is basically formed in a plate shape and may include the frame part 202 forming the edge of the lower shelf 200 and formed of plastic and a plate part 204 coupled with the inside of the frame part 202 and mainly formed of transparent tempered glass.

Figure 6:
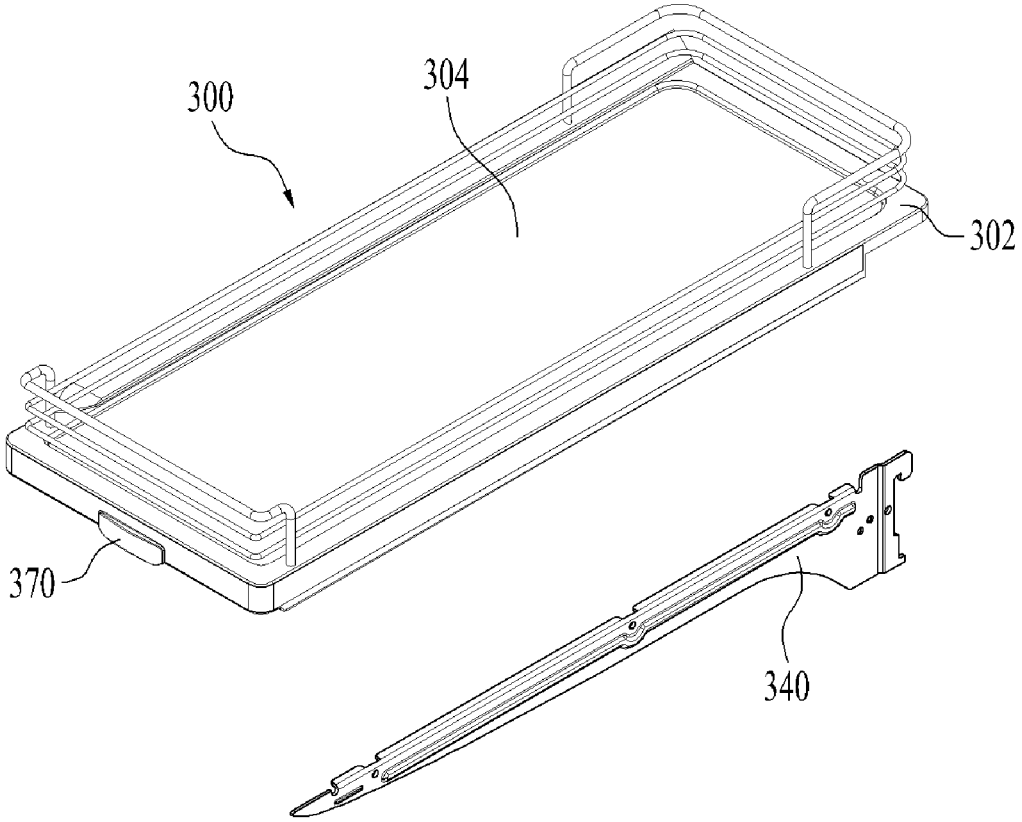
FIG. 6 is an exploded perspective view illustrating support of an upper shelf by a shelf frame.

In the same manner as the lower shelf 200, the upper shelf 300, as exemplarily shown in FIG. 6, may include a frame part 302 forming the edge of the upper shelf 200 and formed of plastic and a plate part 304 coupled with the inside of the frame part 302 and mainly formed of transparent tempered glass.

Further, as exemplarily shown in FIG. 6, the right side of the upper shelf 300 may be slidably supported by the shelf frame 340 mounted on and supported by the right wall of the refrigerating chamber 20.

For this purpose, as exemplarily shown in FIG. 7, a guide groove 306, into which the upper portion of the shelf frame 340 is inserted so as to guide sliding of the upper shelf 300, may be formed on the lower surface of the right side of the frame part 302 of the upper shelf 300.

The shelf frame 340 has a vertical plate shape, and the upper surface of the shelf frame 340 is a flat surface having a small width.

Correspondingly, the guide groove 306 may have an opened lower surface and have a C-shaped longitudinal section.

Further, although this embodiment describes the guide groove 306 as directly contacting the upper surface of the shelf frame 340, a plurality of rollers may be mounted on the shelf frame 340 so that the guide groove 306 is supported by the rollers.

The refrigerator may further include a rotary shelf 400 provided below the upper shelf 300 so as to be rotated upward and downward, as exemplarily shown in FIG. 3.

The rotary shelf 400 may be suspended by a plurality of rotatable links 410 and 420 under the upper shelf 300.

The plurality of links 410 and 420 may include four links 410 and 420, each of which is provided with one end rotatably combined with the side surface of the rotary shelf 400, and the other end of the four links 410 and 420 may be inserted into a hole formed in the frame part 302 of the upper shelf 300.

The plural links 410 and 420 may be locked when the links 410 and 420 are rotated upward, and then maintain such a state.

For this purpose, the upper shelf 300 may include a button device 370 to release the locking state of the plural links 410 and 420 which is rotated upward and locked.

The button device 370 is provided on a front surface of the upper shelf 300 so that at least a part of the button device 370 is exposed and thus a user may easily approach and press the button device 370.

The button device 370 fixes the rotary shelf 400 so that, when the rotary shelf 400 is rotated upward and thus raised, such a state of the rotary shelf 400 is maintained, as exemplarily shown in FIG. 7.

The button device 370 extends sideward along the inside of the frame part 302 of the upper shelf 300 and fixes at least two of the plural links 410 and 420 so as not to rotate the at least two of the plural links 410 and 420.

Figure 9:
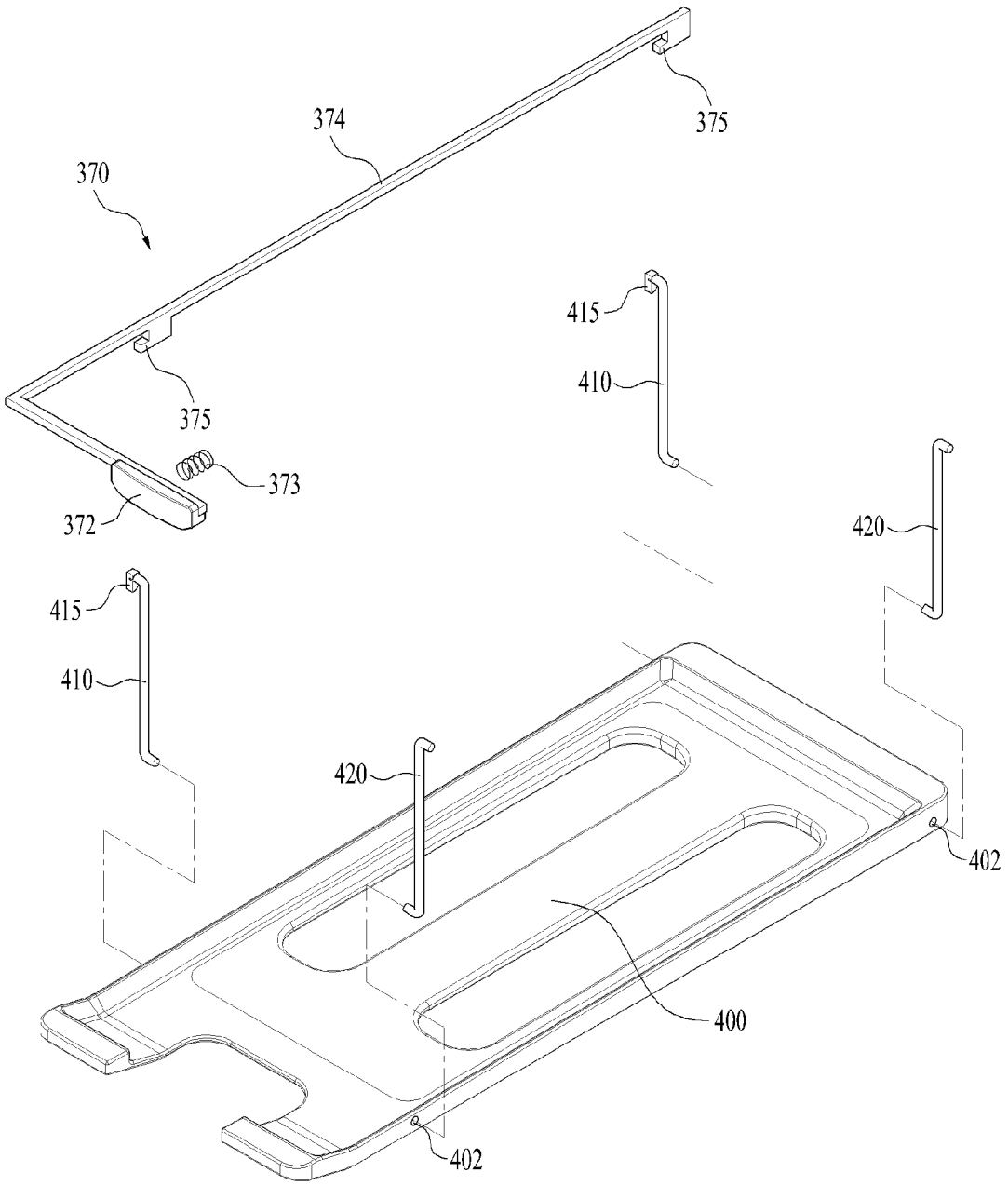
FIG. 9 is an exploded perspective view illustrating a rotary shelf, a plurality of links supporting the rotary shelf, and a button device.

With reference to FIG. 9, the detailed structure of the button device 370 will be described.

The button device 370 includes a button part 372 mounted on the front surface of the upper shelf 300 and a moving member 374 extending from the button part 372 to the side surface of the upper shelf 300 and slidably mounted.

The button part 372 is mounted in a slot formed at the center of a front surface of the frame part 302 of the upper shelf 300 and is exposed forward so that a user may press the button part 372.

The moving member 374 extends leftward from the button part 372 and then extends backward along the inside of the frame part 302.

The moving member 374 may be formed separately from the button part 372 and then combined with the button part 372, or may be formed integrally with the button part 372.

The moving member 374 is movable in the forward and backward directions within the frame part 302 of the upper shelf 300 according to pressing of the button part 372 by a user.

Although the embodiment of FIG. 9 illustrates the moving member 374 as being provided at the left side of the upper shelf 300, the moving member 374 may be provided at the right side or both sides of the upper shelf 300.

The moving member 374 extends up to a position where at least a pair of first links 410 located at the left among the plurality of links 410 and 420 is located.

A cam part 415 protrudes from the tip of a rotary shaft of the upper end of each of the pair of first links 410.

Correspondingly, locking parts 375 are formed on the lower surface of the moving member 374 at positions corresponding to the cam parts 415.

The locking part 375 extends downward from the moving member 374 and then protrudes forward, thus forming a locking hole into which the cam part 415 may be selectively inserted.

Since one side surface of the cam part 415 is curved so as to contact the locking part 375, when the cam part 415 is rotated and pushes the locking part 375, the locking part 375 may be smoothly pushed.

The button device 370 may further include an elastic member 373 providing elastic force in a forward protruding direction of the button part 372.

FIG. 9 illustrates a coil spring as the elastic member 373. The rear end of the elastic member 373 may be fixed to the slot formed on the center of the front surface of the frame part 302, and the front end of the elastic member 373 may be fixed to the rear surface of the button part 372.

Other types of springs than the coil spring, such as a leaf spring, may be used as the elastic member 373, and the elastic member 373 may be installed at one side of the moving member 374 instead of in the rear of the button part 372.

In contrast to the first links 410, a pair of links 420 located at the right among the links 410 and 420 will be referred to as second links 420.

The second links 420 are provided symmetrically with the first links 410 except that cam parts 415 are omitted in the second links 420.

Figure 10:
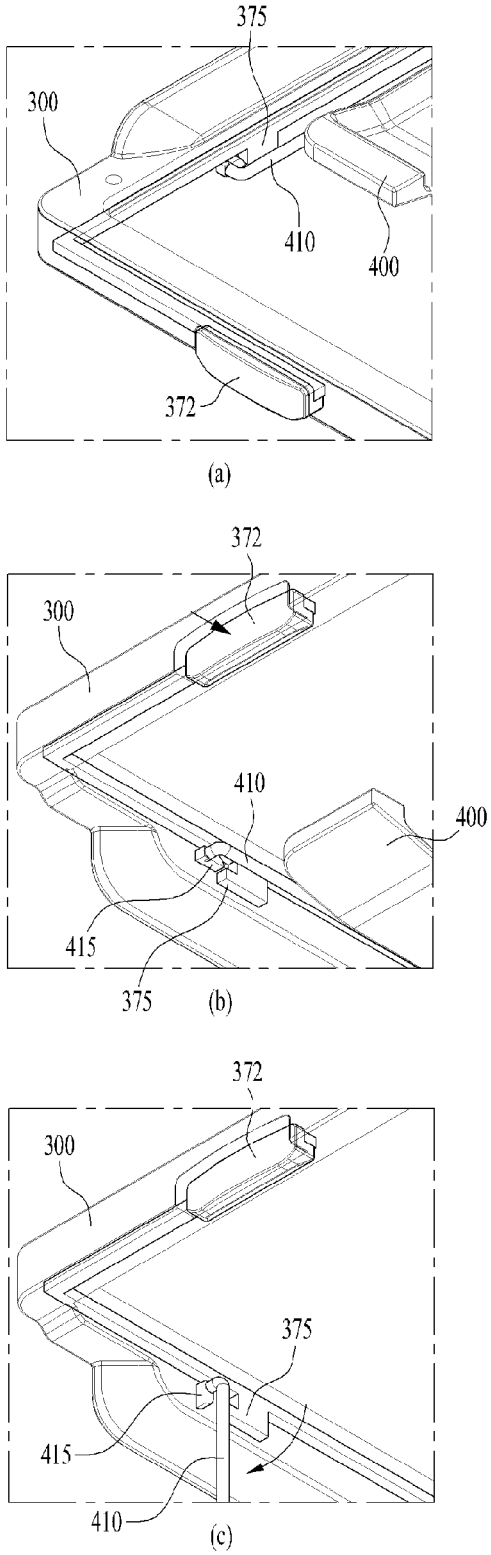
FIGS. 10(*a*) to 10(*c*) are perspective views illustrating an operating process of the button device.

With reference to FIGS. 10(*a*) to 10(*c*), rotation of the first links 410 of the rotary shelf 400 according to operation of the button device 370 will be described.

FIG. 10(*a*) is a partial perspective view of the upper shelf, as seen from the top, and FIGS. 10(*b*) and 10(*c*) are partial perspective views of the upper shelf, as seen from the bottom.

As exemplarily shown in FIG. 10(*a*), in a state in which the rotary shelf 400 is rotated upward, the cam parts 415 of the first links 410 are locked and supported by the locking part 375.

In such a state, the cam parts 415 are not rotated and thus, the rotary shelf 400 supported by the first links 410 is not rotated downward and is not lowered.

When a user presses the button part 372, as exemplarily shown in FIG. 10(*b*), the cam parts 415 are released from the locking parts 375.

In such a state, the cam parts 415 are not supported and thus, the first links 410 are rotated downward by gravity and the rotary shelf 400 is rotated downward and is lowered.

FIG. 10(*c*) illustrates a state in which the first links 410 are rotated downward.

FIG. 10(*c*) illustrates the button part 372 as being in the pressed state. When user force pressing the button 372 is removed, the button part 372 tends to restore to an original state thereof by the elastic member 373.

However, if the locking parts 375 horizontally move toward the cam parts 415 and contact the cam parts 415 according to movement of the button part 372, the locking parts 375 do not move any more by means of the cam parts 415.

In this case, the button part 372 may maintain a slightly pressed state rather than a completely restored position, and the user may detect the position of the rotary shelf 400 only by observing the current position of the button part 372.

Then, when the user again rotates the rotary shelf 400 upward to raise the rotary shelf 400, the cam parts 415 are rotated while smoothly pushing one side surface of each of the locking parts 375, and when the cam parts 415 are rotated completely and raised, the cam parts 415 may be locked and supported by the locking parts 375, as exemplarily shown in FIG. 10(*a*).

In the refrigerator in accordance with this embodiment of the present invention, articles having small widths and large heights, such as large beverage cans and bottles or Kimchi containers, may be easily accommodated on the lower shelf 200 and retrieved from the lower shelf 200.

Further, articles having relatively small widths and heights may be easily accommodated on the upper shelf 300 and retrieved from the upper shelf 300.

Further, since both sides of the lower shelf 200 and the upper shelf 300 are slidably supported, the lower shelf 200 and the upper shelf 300 may be pulled out and stably support heavy articles.

Further, the connection bars 250 are selectively connected between the lower shelf 200 and the upper shelf 300 and thus, the lower shelf 200 and the upper shelf 300 may be simultaneously pulled out.

Moreover, the rotary shelf 400 is provided below the upper shelf 300 and thus, if articles having small heights are accommodated on the lower shelf 200, the rotary shelf 400 may be lowered so that beverage cans or bottles may be accommodated on the rotary shelf 400 and thus, space below the upper shelf 400 may be more effectively used.

Hereafter, a refrigerator in accordance with another embodiment of the present invention will be described with reference to FIGS. 11 to 18.

The configurations of a main body, storage chambers, a drawer assembly, and a cover shelf of the refrigerator in accordance with this embodiment are substantially the same as those in the refrigerator in accordance with the former embodiment, and a detailed description thereof will thus be omitted.

Figure 11:
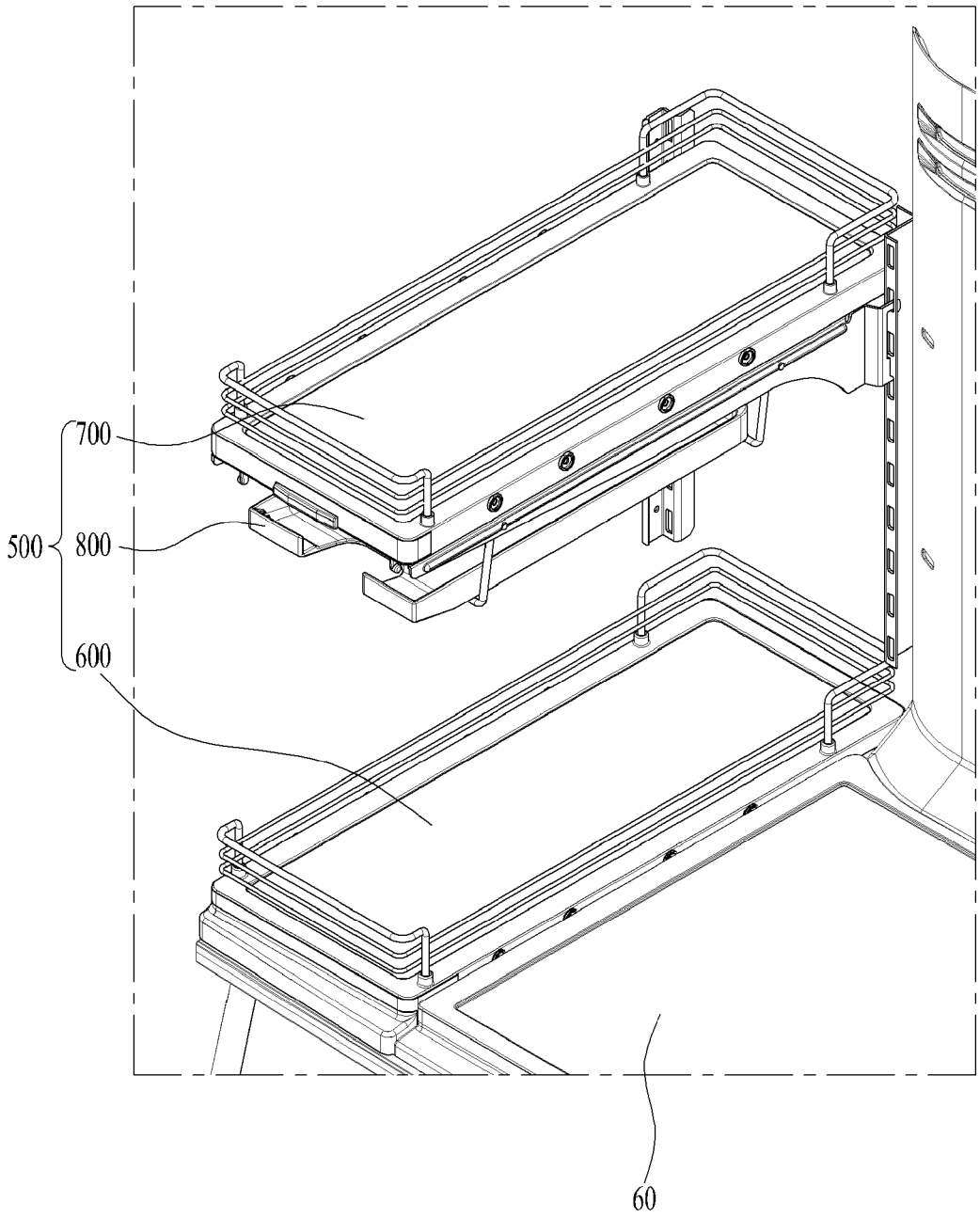
FIG. 11 is a perspective view illustrating a shelf assembly of a refrigerator in accordance with another embodiment of the present invention.

As exemplarily shown in FIG. 11, a shelf assembly 500 in accordance with this embodiment includes a lower shelf 600 and an upper shelf 700 in the same manner as the shelf assembly 100 in accordance with the former embodiment, but differs from the shelf assembly 100 in accordance with the former embodiment in terms of the support structures of the lower shelf 600 and the upper shelf 700.

That is, the lower shelf 600 is disposed between the cover shelf 66 (with reference to FIG. 6) and the sidewall of the refrigerating chamber 20, and the lower portions of both sides of the lower shelf 600 are supported by the upper surface of the drawer assembly 60 so as to be pulled out.

Further, the upper shelf 700 is disposed above the upper shelf 600, and the lower portions of both sides of the upper shelf 700 are supported by a pair of shelf frames 720 (with reference to FIG. 12) mounted on the rear wall of the refrigerator 200 so as to be pulled out.

Figure 12:
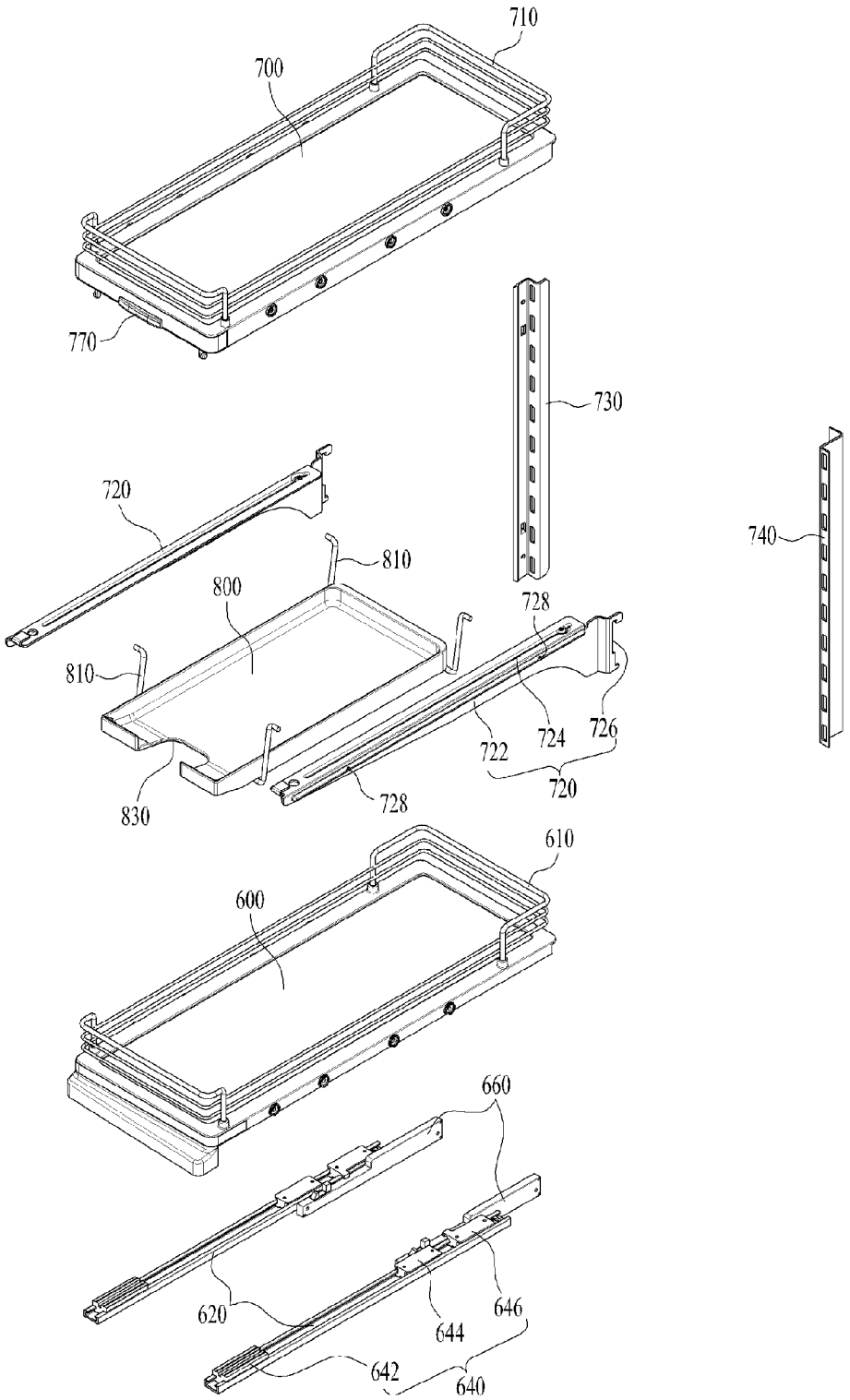
FIG. 12 is an exploded perspective view of the shelf assembly of FIG. 11.

FIG. 12 is an exploded perspective view of the shelf assembly 500.

The lower shelf 600 includes a pair of guide rails 620 mounted at both sides of the cover 62 (with reference to FIG. 5) of the drawer assembly 60 and at least one slider 640 slidably mounted on each of the guide rails 620.

The guide rails 620 may have a shape of a rectangular pipe extending in the forward and backward directions and provided with an upper surface, at least a part of which is opened.

At least the lower half of the slider 640 is inserted into the guide rail 620 so that the slider 640 slides in the forward and backward directions but is not separated from the guide rail 620 in the upward and downward directions.

For this purpose, the width of the upper opening of the guide rail 620 may be smaller than the width between the inner side surfaces of the guide rail 620, the upper ends of the guide rail 620 may protrude opposite to each other, and grooves into which the protruding upper ends of the guide rail 620 are inserted are formed on the side surfaces of the slider 640.

The slider 640 may be combined with a frame part of the lower shelf 600 by screws.

In this embodiment, the at least one slider 640 includes a first slider 642 disposed at the foremost position, a second slider 644 disposed at the middle position, and a third slider 646 disposed at the rearmost position.

The first slider 642 may be disposed at a position where the first slider 642 is released from the guide rail 620 and the second slider 644 and the third slider 646 may be disposed at positions where the second slider 644 and the third slider 646 are not released from the guide rail 620, when the lower shelf 600 is pulled out.

Therefore, the second slider 644 and the third slider 646 are disposed at adjacent positions of the rear portion of the guide rail 620.

Only one slider 640 may be provided for each guide rail 620 as long as the slider 640 may withstand moment due to load when the upper shelf 600 is pulled out.

However, since such moment should be sufficiently withstood in consideration of the weight of stored articles, if only one slider 640 is provided, the length of the slider 640 may increase, as compared to the case in that two or three sliders are provided.

Further, the lower shelf 600 may further include stopper members 660 restricting the moving distance of the sliders 640 to the guide rails 620.

Since the guide rails 620 form a pair and the sliders 640 form a pair, the stopper members 660 may form a pair.

Such a pair of stopper members 660 is mounted on the inner sides of the pair of guide rails 620 and the cover 62, thus being fixed.

Figure 13:
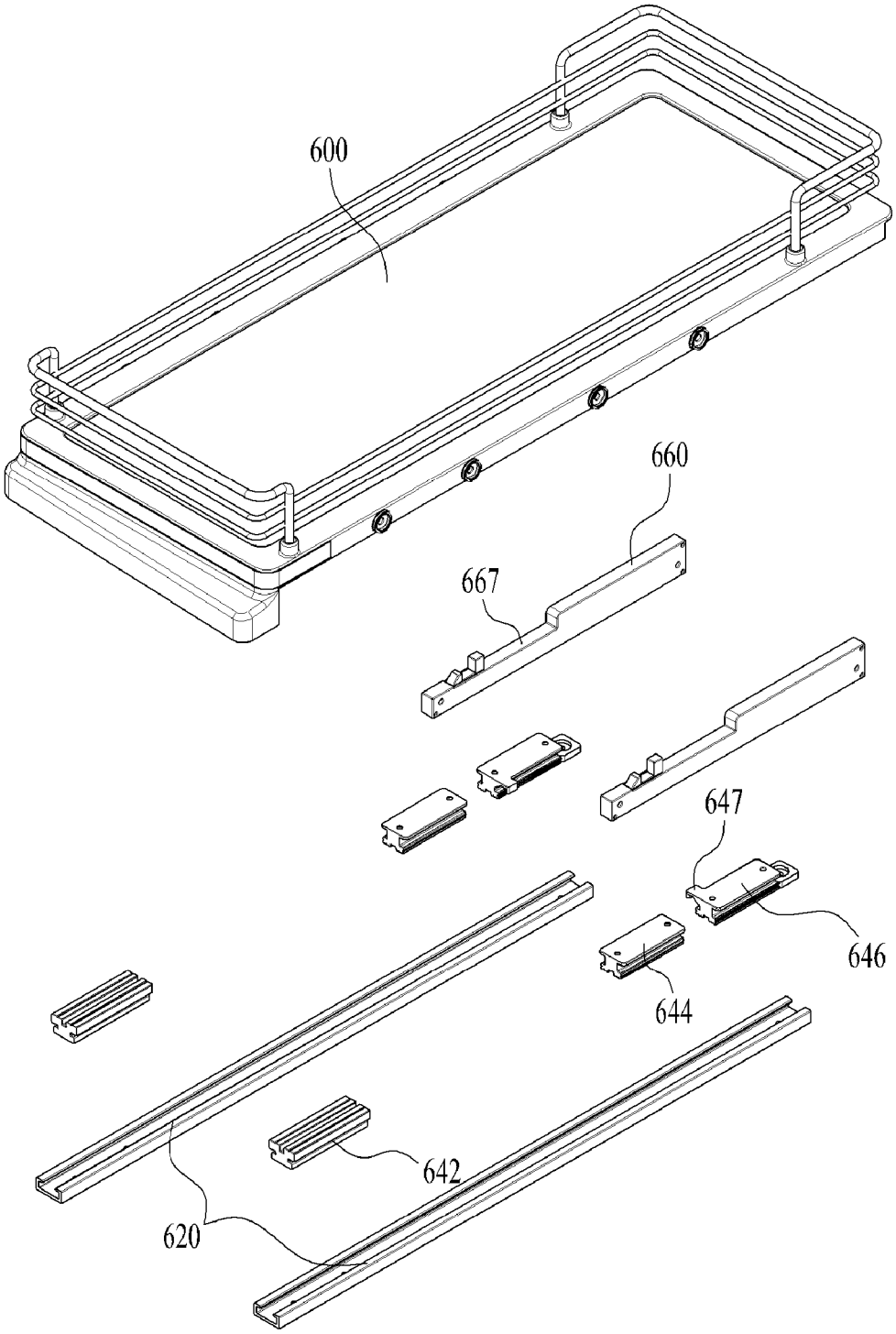
FIG. 13 is an exploded perspective view illustrating a sliding support structure of a lower shelf.

FIG. 13 is an exploded perspective view of the lower shelf.

A stopper protrusion 647 protruding sideward is provided on the inner side of the third slider 646 of the sliders 640, and a stopper groove 667 is provided on the upper surface of the stopper member 660.

The stopper protrusion 647 is inserted into the stopper groove 667 in the sideward direction, and the moving distance of the stopper protrusion 647 in the forward and backward directions is restricted by the distance between the front and rear ends of the stopper groove 667.

A front protrusion forming the front end of the stopper groove 667 may be manufactured separately from the stopper member 660 and be inserted into a slot formed on the stopper member 660.

In this case, after the stopper protrusion 647 is disposed on the stopper groove 667 under the condition that the third slider 646 is inserted into the guide rail 620, the front protrusion may be inserted into the slot formed on the stopper member 660. Thereby, assembly may be more easily carried out.

Figure 14:
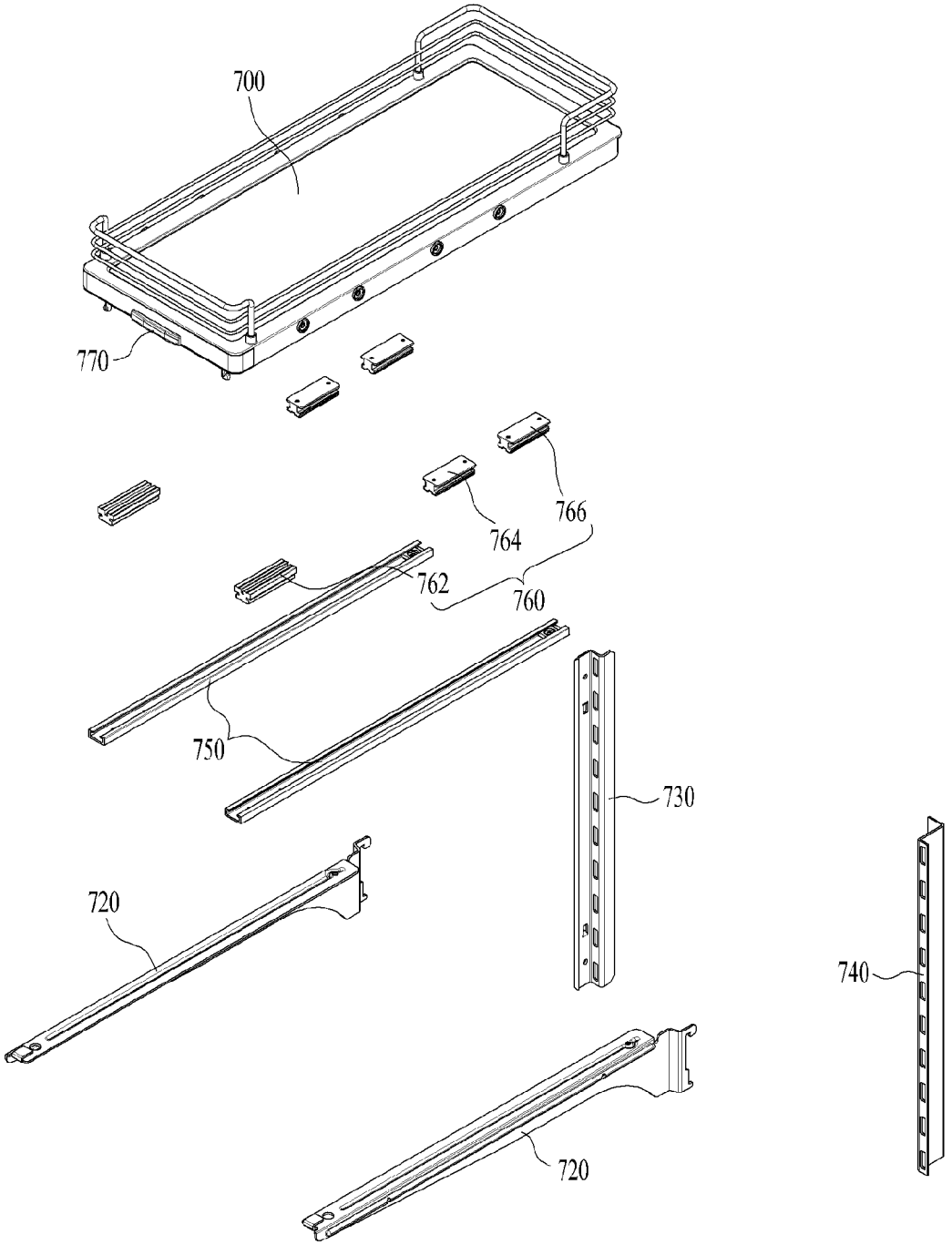
FIG. 14 is an exploded perspective view illustrating a sliding support structure of an upper shelf.

FIG. 14 is an exploded perspective view of the upper shelf.

The upper shelf 700 includes a pair of guide rails 750 supported by the pair of shelf frames 720 and at least one slider 760 slidably mounted on each of the guide rails 750.

The upper shelf 700 differs from the lower shelf 600 in that the guide rails 750 of the upper shelf 700 are supported by the shelf frames 720.

Further, the upper shelf 700 does not include stopper members. The reason for this is that it is difficult to mount the stopper members on the shelf frames 720.

However, if the shelf frames 720 are formed in a shape on which the stopper members may be mounted, the stopper members may be provided on the upper shelf 700.

Such a pair of shelf frames 720 is mounted on a pair of cantilever brackets 730 and 740 mounted on the rear wall of the storage chamber.

The pair of cantilever brackets 730 and 740 includes a first cantilever bracket 730 installed at the corner where the sidewall and the rear wall of the storage chamber meet and a second cantilever bracket 740 installed on the rear wall of the storage chamber.

Coupling holes may be formed the side portion of the first cantilever bracket 730 so that the first cantilever bracket 730 may be coupled with the sidewall of the storage chamber by screws, etc.

On the other hand, coupling holes may be formed on the rear portion of the second cantilever bracket 740 so that the second cantilever bracket 740 may be coupled with the rear wall of the storage chamber by screws, etc.

Of course, the two cantilever brackets 730 and 740 are the same in that the cantilever brackets 730 and 740 extend vertically and a plurality of shelf frame insertion holes is arranged on the cantilever brackets 730 and 740 in the vertical direction.

Since the plurality of shelf frame insertion holes is formed on the cantilever brackets 730 and 740, the height of the shelf frames 720 may be selectively adjusted, the height of the upper shelf 700 may be adjusted thereby, and thus, an interval between the lower shelf 600 and the upper shelf 700 may be adjusted.

Referring to FIG. 12 again, the shelf frame 720 includes a vertical part 722 formed in a vertical plate shape so as to withstand vertical moment, a horizontal part 724 combined with the upper surface of the vertical part 722 or integrally connected to the upper surface of the vertical part 722, and a combining part 726 protruding backward from the rear end of the vertical part 722 and combined with the cantilever bracket 730 or 740.

Although the horizontal part 724 of the shelf frame 720 may be formed integrally with the vertical part 722 and the combining part 726 so as to increase strength of the shelf frame 720, the horizontal part 724 may be manufactured separately and be coupled with the vertical part 722.

Since the shelf frame 720 includes the horizontal part 724, the pair of guide rails 750 may be stably combined with the horizontal parts 724 of the shelf frames 720.

In the same manner as the at least one slider 640 of the lower shelf 600, the at least one slider 760 of the upper shelf 700 may include three sliders, i.e., a first slider 762, a second slider 764, and a third slider 767, for each guide rail 750.

Since the upper shelf 700 does not include stopper members, as described above, protrusions corresponding to the stopper members are not formed on the third slider 766 and the third slider 766 may have the same shape as the second slider 764.

Since the sliders 760 slide with respect to the guide rails 750, low friction at contact regions therebetween the sliders 760 and the guide rails 750 is advantageous.

The guide rails 750 may be formed of a metal, particularly, a steel sheet, and the sliders 760 may be formed of plastic causing low friction with the guide rails 750.

Since the sliders 760 slide on the guide rails 750, the sliders 760 may be formed of a material causing low friction with the guide rails 750 and having excellent abrasion resistance.

For example, ultra high molecular weight polyethylene (UHMW-PE) may be used as such a material. UHMW-PE is known as the product name GUR.

UHMW-PE has excellent abrasion resistance, impact resistance, and self-lubricity and has a very low coefficient of friction, thus being suitable to be used as a sliding part.

In addition to the sliders 760, the guide rails 750 may be formed of UHMW-PE.

Further, in the same manner as the sliders 760 of the upper shelf 700, the sliders 660 of the lower shelf 60 may be formed of UHMW-PE.

As exemplarily shown in FIGS. 11 and 12, the lower shelf 600 and the upper shelf 700 may further include wall parts 610 and 710 installed at the edges of the upper surfaces thereof so as to prevent articles accommodated on the lower shelf 600 and the upper shelf 700 from falling to the outside of the lower shelf 600 and the upper shelf 700.

The wall parts 610 and 710 are formed of a wire of a designated diameter and prevent stored articles accommodated on the lower shelf 600 and the upper shelf 700 from falling to the outside of the lower shelf 600 and the upper shelf 700, in the same manner as the former embodiment.

The wall parts 610 and 710 are not limited to the above-described shape, and may be provided in a panel shape extending upward from the edge of each of the lower shelf 600 and the upper shelf 700.

As exemplarily shown in FIGS. 11 and 12, the shelf assembly 500 in accordance with this embodiment of the present invention may further include a rotary shelf 800 provided below the upper shelf 700 so as to be rotated upward and downward.

The rotary shelf 800 may be supported by a plurality of rotatable links 810 provided under the upper shelf 700. The rotary shelf 800 may be configured such that, when the rotary shelf 800 is rotated upward, the state of the rotary shelf 800 may be fixed.

Figure 15:
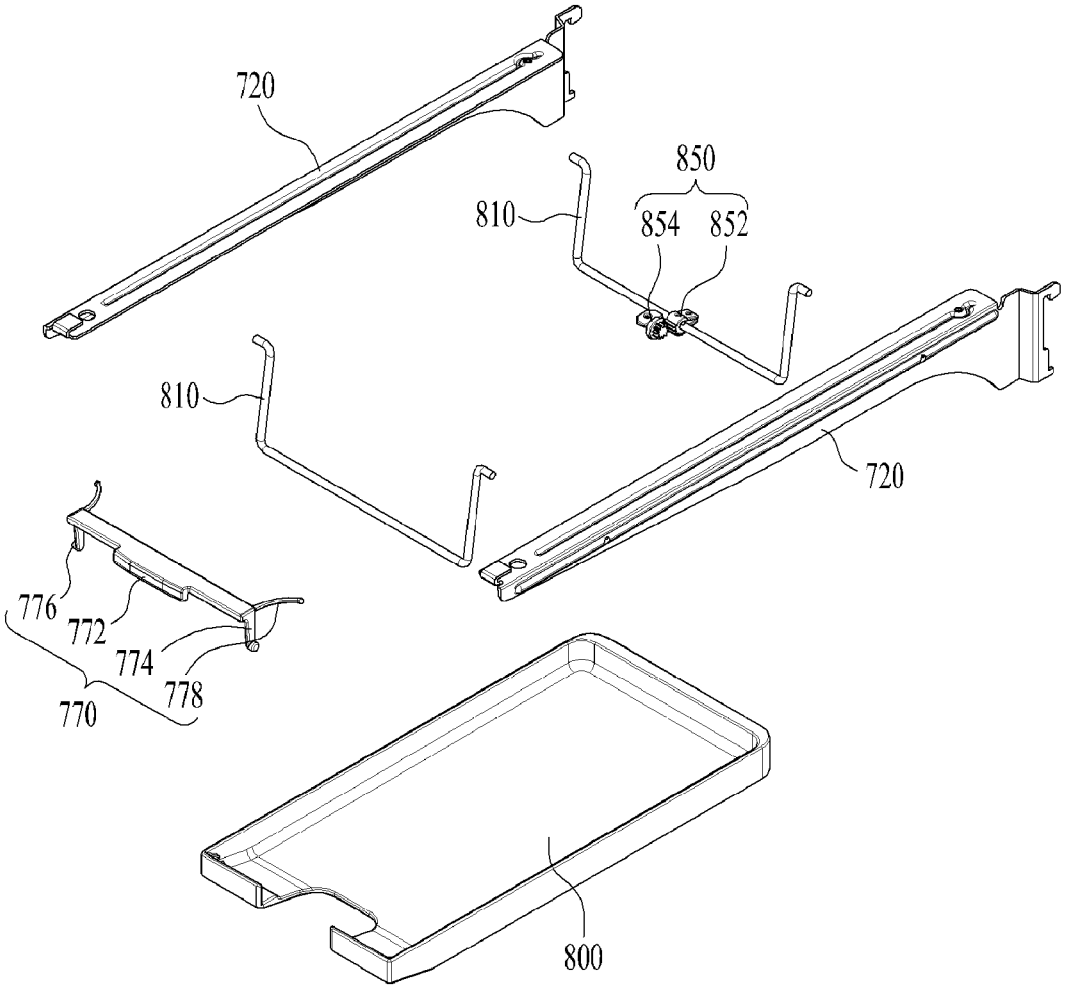
FIG. 15 is an exploded perspective view illustrating a rotary shelf assembly.

The plural links 810 may be formed of a C-shaped wire, as exemplarily shown in FIG. 15.

Therefore, differently from the former embodiment, the plural links 810 may be rotatably combined with the lower surface of the upper shelf 700 rather than the side surface of the upper shelf 700. Thus, two links 810 having the same shape are disposed at the front and rear portions of the upper shelf 700.

The shelf assembly 500 in this embodiment differs from the shelf assembly 100 in the former embodiment in that rotary shafts at the upper ends of the link 810 are inserted into each of shaft holes 728 (with reference to FIG. 12) formed on the shelf frames 720 rather than a frame part of the upper shelf 700.

Figure 17:
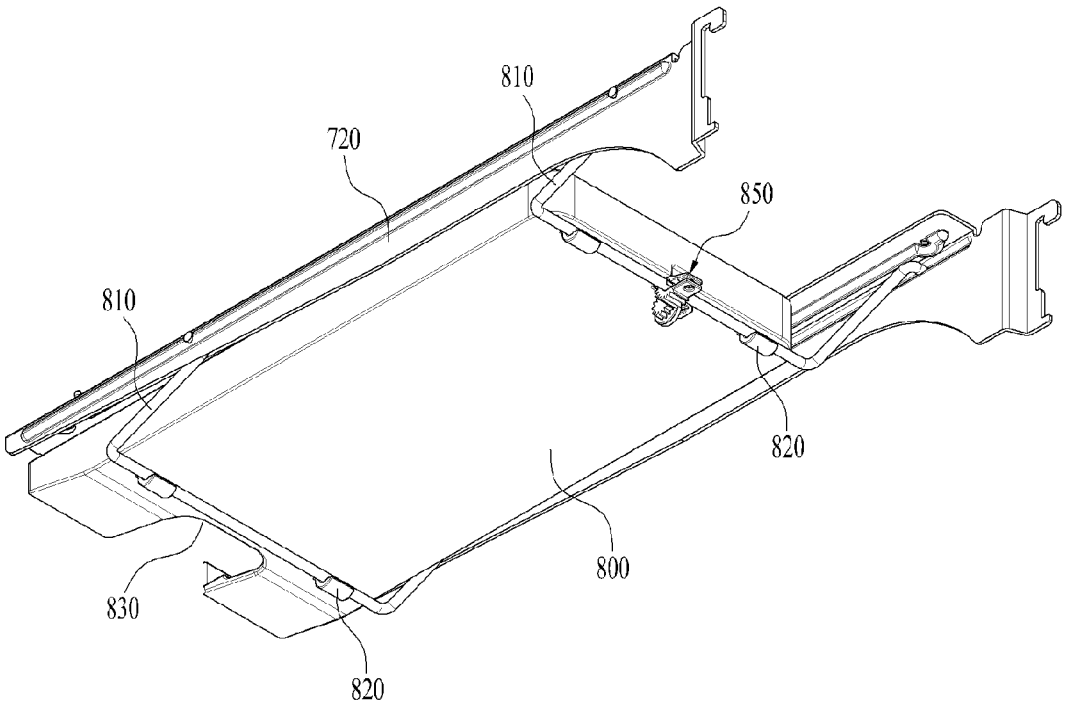
FIGS. 17 and 18 are perspective views illustrating operation of a damping device during rotation of the rotary shelf.

As exemplarily shown in FIG. 17, the plural links 810 may be mounted on link mounting parts 820 protruding from the lower surface of the upper shelf 700.

The link mounting part 820 may be provided with an opening formed in the sideward direction so that the link 810 may be easily attached to and detached from the link mounting part 820 through the opening.

Since, when the rotary shelf 800 is rotated upward, the upward rotated state of the rotary shelf 800 may be fixed, and the two links 810 are not fixed in this embodiment, the two links 810 having the same shape may be used.

In this embodiment, the upper shelf 700 may include a button device 770 releasing the locking state of the rotary shelf 800 which has been rotated upward and then locked.

The button device 770 in accordance with this embodiment differs from the button device 370 in accordance with the former embodiment in that the button device 770 has a different shape from the button device 370 and selectively fixes the rotary shelf 800 rather than the links 810.

Figure 16:
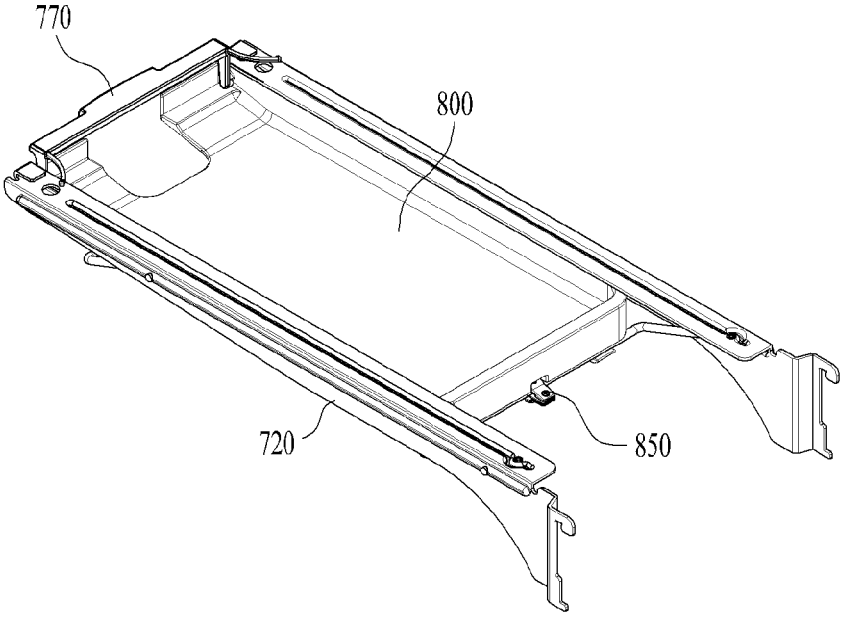
FIGS. 16(*a*) and 16(*b*) are perspective views illustrating upward and downward rotated states of a rotary shelf.
Figure 16:
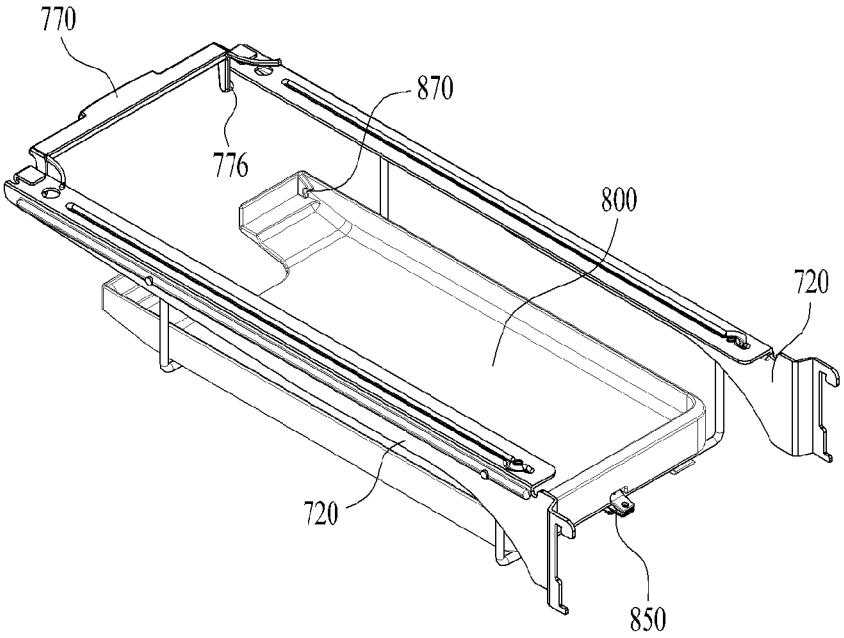

In more detail, as exemplarily shown in FIGS. 15 and 16, the button device 770 includes a button part 772 mounted on a front surface of the upper shelf 700, extending support parts 774 extending downward from both sides of the button part 772, and support protrusions 776 protruding sideward from the ends of the extending support parts 774 and locked to locking hooks 870 formed on the upper surface of a front portion of the rotary shelf 800 when the rotary shelf 800 is rotated upward.

The button part 772 is mounted within the frame part of the upper shelf 700 so that a part of the button part 772 is exposed from the front surface of the frame part.

The extending support parts 774 extend sideward from both sides of the button 772 and then extend downward.

The support protrusions 776 protruding sideward are formed at the ends of the extending support parts 774. The support protrusions 776 are selectively locked to the locking hooks 870 shown in FIG. 16(*b*) and thus, support the rotary shelf 800 so as not to rotate the rotary shelf 800 downward.

A pair of extending support parts 774 and a pair of support protrusions 776 are provided at both sides of the button part 772 so as to be symmetrical to each other. Correspondingly, two locking hooks 870 are formed.

The button device 770 may be pressed by a user and restore an original position thereof when user force pressing the button 372 is removed.

For this purpose, the button device 770, as exemplarily shown in FIG. 15, may further include a pair of elastic support parts 778 extending in an arc shape rearward from the side ends of the extending support parts 774 so that the ends of the elastic support parts 778 are supported by both sides of the lower surface of the upper shelf 700 and are elastically deformed to provide restoring force to the button part 772 when the button part 772 is pressed.

The elastic support parts 778 may be formed integrally with the button part 772, the extending support parts 774, and the support protrusions 776.

The elastic support parts 778 may extend rearward from the side ends of the extending support parts 774 and be formed in an arc shape such that the elastic support parts 778 are stretched outward in the rearward direction.

The ends of the elastic support parts 778 are supported within the frame part of the upper shelf 700 and thus, even if the button part 772 is pressed, the relative positions of the ends of the elastic support parts 778 to the upper shelf 700 are maintained.

Since the elastic support parts 778 are formed in an arc shape, the elastic support parts 778 are elastically deformed when the button part 772 is pressed and restore the button part 772 to an original position thereof when force of pressing the button part 772 is removed.

When the button part 772 is pressed, the support protrusions 776 move rearward. Since the locking hooks 870 are opened rearward, the support protrusions 776 may be released from the locking hooks 870.

When the button part 772 is pressed, the support protrusions 776 are released from the locking hooks 870 and thus, the rotary shelf 800 is rotated downward by gravity and then lowered.

FIG. 16(*a*) illustrates a state in which the support protrusions 776 of the button part 772 are locked to the locking hooks 870 and thus, the rotary shelf 800 is raised close to the upper shelf 700 and fixed.

FIG. 16(*b*) illustrates a state in which locking of the support protrusions 776 to the locking hooks 870 is released by pressing the button part 772 and thus, the rotary shelf 800 is rotated downward.

The rotary shelf 800 may be inclined forward by a designated angle when the rotary shelf 800 is rotated downward.

The rotary shelf 800 may accommodate, for example, a plurality of beverage cans in the leftward and rightward directions or one or two containers, such as large bottles, in the forward and backward directions.

Particularly, the rotary shelf 800 may accommodate a plurality of small cans or bottles in the leftward and rightward direction. In this case, by mounting the rotary shelf 800 so as to be inclined forward, the accommodated cans or bottles slide forward by gravity and a user may easily retrieve the cans or bottles from the rotary shelf 800.

Further, a wall part having a designated height may be formed at the edge of the rotary shelf 800 so as to prevent articles accommodated on the rotary shelf 800 from falling to the outside of the rotary shelf 800.

As exemplarily shown in FIG. 17, a withdrawal hole 830 may be formed at the front portion of the rotary shelf 800 so that a user may easily grasp an accommodated can or bottle by hand.

The rotary shelf 800 may further include a damping device 850 provided on at least one of the plural links 810 and damping the rotating speed of the links 810 and impact applied to the links 810 when the links 810 are rotated downward and lowered.

The damping device 850, as exemplarily shown in FIG. 15, may include a rotary gear unit 852 coupled with one of the plural links 810 and rotated together with the links 810, and a damper unit 854 including a driven gear unit mounted on the lower portion of the rotary shelf 800 and engaged with the rotary gear unit 852, and damping the rotating speed of the driven gear unit.

Although FIG. 15 illustrates the damping device 850 as being provided at the rear link 810 among the plural links 810, the damping device 850 may be provided at each of the two links 810.

The rotary gear unit 852 is coupled with the link 810, thus being fixed. As shown in FIG. 15, the rotary gear unit 852 may be coupled with the link 810 by a screw so as to surround the link 810.

The rotary gear unit 852 may be assembled with the link 810 using other methods, i.e., a method in which, if the rotary gear unit 852 is fixed to the link 810 and rotated together with the link 810 and a gear is formed at one side of the rotary gear unit 852, the rotary gear unit 852 is coupled with the link 810 using a coupling part separately formed on the link 810.

With reference to FIGS. 15 and 17, the damper unit 854 is coupled with the lower surface of the rotary shelf 800 by a screw.

For this purpose, a screw coupling hole is formed at one side of a main body of the damper unit 854 and a screw coupling hole corresponding to the screw coupling hole of the damper unit 854 is formed on the lower surface of the rotary shelf 800.

The driven gear unit engaged with the rotary gear unit 852 and rotated is provided at the other side of the damper unit 854.

Although not shown in the drawing, a damper damping rotation of the driven gear unit is provided within the damper unit 854.

The damping mechanism of the damper may be implemented by a spring or using a pressurized fluid.

By means of the damper action of the damper unit 854, when the driven gear unit is rotated according to rotation of the rotary gear unit 852, rotation of the driven gear unit may be damped.

In more detail, in the upward rotated state of the rotary shelf 800, as exemplarily shown in FIG. 17, the damping device 850 does not generate damping force or elastic force or generates slight damping force or elastic force.

Figure 18:
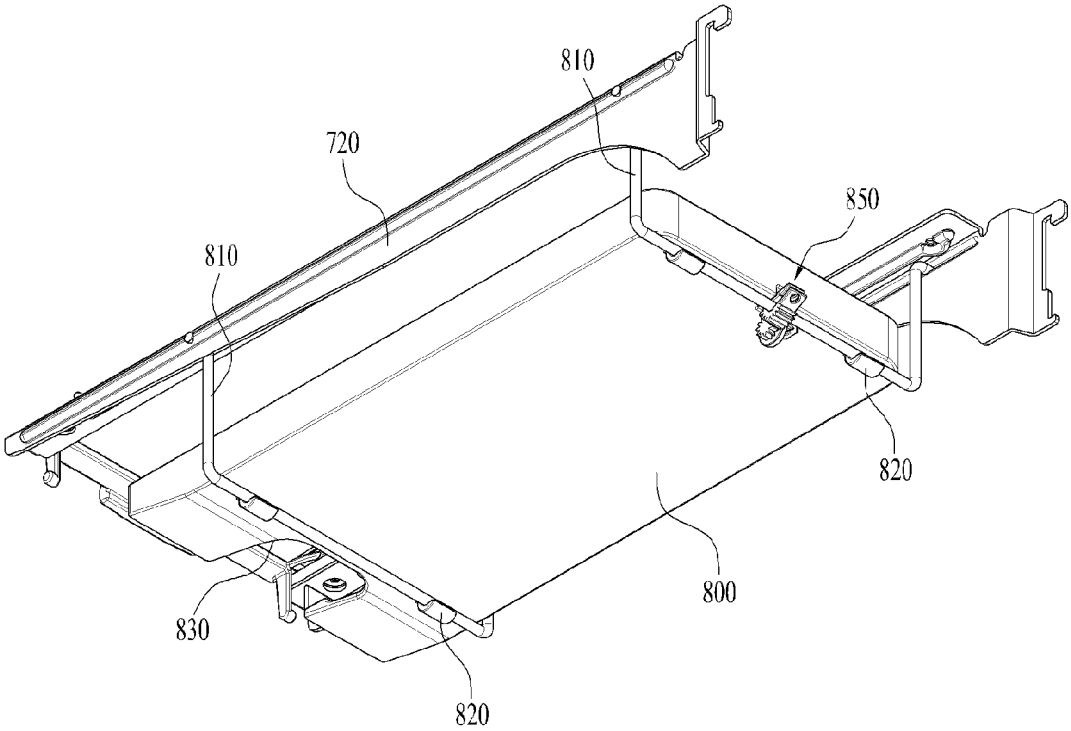

On the other hand, when the rotary shelf 800 is rotated downward and lowered, as exemplarily shown in FIG. 18, the rotary gear unit 852 is rotated together with the link 810 and rotates the driven gear unit.

Then, the damper unit 854 damps rotation of the driven gear unit and thus damps rotation of the rotary gear unit 852, thereby damping downward rotation of the rotary shelf 800.

Further, as exemplarily shown in FIG. 18, an interference prevention slot preventing interference with the rotary gear unit 852 may be formed at a position of the lower surface of the rotary shelf 800, corresponding to the mounting position of the rotary gear unit 852.

Further, when the rotary shelf 800 is rotated downward and lowered, the rotary shelf 800 may pass by the lowest point by gravity, even if damping action is applied to the rotary shelf 800.

Therefore, the interference prevention slot of the rotary shelf 800 may be formed so as to serve as a stopper in consideration of the position of the rotary shelf 800 when the rotary gear unit 852 is maximally rotated.

In the refrigerator in accordance with this embodiment of the present invention, the shelf assembly 500 does not use a rail assembly having a complicated structure and need not contact the sidewall of the storage chamber and thus, the installation position of the shelf assembly 500 is not restricted.

Further, since the lower portions of both sides of the lower shelf 600 and the upper shelf 700 are very stably supported by the guide rails and the sliders so as to be slidable, the lower shelf 600 and the upper shelf 700 may be stably supported and easily pulled out even if heavy articles are accommodated on the lower shelf 600 and the upper shelf 700.

Further, since both sides of the upper shelf 700 are supported by the shelf frames and the shelf frames are mounted on the cantilever brackets provided with a plurality of insertion holes formed in the vertical direction, the height of the upper shelf 700 may be easily adjusted. Thereby, the interval between the lower shelf 600 and the upper shelf 700 may be easily adjusted.

As described above, in accordance with embodiments of the present invention, the left and right sides of the lower shelf and the upper shelf are slidably supported by the rail assembly and the shelf frame, the rail assembly and the rollers on the drawer cover, a pair of shelf frames, or a pair of guide rails and the sliders.

Although the embodiments of the present invention describe the upper shelf and the lower shelf as being provided together, the embodiments of the present invention may be applied to a refrigerator including only one of the upper shelf and the lower shelf.

That is, the embodiments of the present invention may be applied to a shelf mounted on a cover of a drawer so as to be pulled out or a shelf mounted at a designated height above a drawer so as to be pulled out, as long as both sides of the shelf may be slidably supported.

Further, in the refrigerator in accordance with the present invention, since both the lower shelf and the upper shelf are mounted so as to be pulled out and the rotary shelf is provided below the upper shelf, a space between the lower shelf and the upper shelf may be effectively and selectively used.

As apparent from the above description, in a refrigerator in accordance with one embodiment of the present invention, both sides of a shelf disposed adjacent to the side portion of a storage chamber are slidably supported and thus, the shelf may be smoothly pulled out by a user with small force under the condition that heavy stored articles are accommodated on the shelf.

Further, an upper shelf and a lower shelf may be simultaneously or independently pulled out and thus, be conveniently used according to user's taste.

Further, a rotary shelf is further provided below the upper shelf and thus a space under the upper shelf may be more effectively used.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A refrigerator comprising:

a main body;

a storage chamber provided within the main body;

a cantilever bracket mounted on a rear wall of the storage chamber and including at least one slit;

a shelf frame mounted on the cantilever bracket by inserting a hook, provided at a rear end of the shelf frame, into the at least one slit, including a guide part formed on an upper surface of the shelf frame, and formed of a metal;

a fixed rail mounted on a sidewall of the storage chamber;

a shelf including a guide groove formed on a lower surface of a first side of the shelf and slidably supported by the guide part of the shelf frame, and a moving rail combined with a second side of the shelf and guided by the fixed rail;

a rotary shelf provided below the shelf that rotates upward and downward, and supported by a plurality of links rotatable under the shelf, wherein the plurality of links is configured to be locked when the plurality of links is rotated upward; and a button device that releases the locking state of the plurality of links rotated upward and locked, the button device including:

a button part mounted on a front surface of the shelf;

a moving member extending from the button part to the second side of the shelf and slidably mounted to be selectively coupled to the plurality of links to lock the plurality of links;

cam parts formed at ends of rotary shafts of links of at least one side among the plurality of links; and locking parts extending downward from a lower surface of the moving member and selectively combined with the cam parts of the links.

2. The refrigerator according to claim 1, wherein the cantilever bracket includes a plurality of slits, the refrigerator further comprising:

a side cantilever bracket mounted on the rear wall of the storage chamber adjacent to the sidewall of the storage chamber;

a pair of shelf frames respectively mounted on the cantilever bracket and the side cantilever bracket; and a fixed shelf mounted on the pair of shelf frames and disposed at the side of the shelf.

3. The refrigerator according to claim 1, wherein the button device further includes an elastic member providing elastic force in a direction of protruding the button device forward.

4. The refrigerator according to claim 1, wherein: the fixed rail is fixed to a fixing frame installed on the sidewall of the storage chamber; and the moving rail is coupled with a moving rail mounting part provided on the second side of the shelf.

5. A refrigerator comprising:

a main body;

a storage chamber provided within the main body;

drawers provided in a lower portion of the storage chamber so as to be pulled out;

a cover mounted on upper surfaces of the drawers so as to cover the upper surfaces of the drawers;

a fixed rail mounted on a sidewall of the storage chamber;

rollers provided in mounting slots formed on an upper surface of the cover; and a shelf including a guide groove formed on lower surface of a first side of the shelf and supported by the rollers, and a moving rail combined with a second side of he shelf and guided by the fixed rail.

6. The refrigerator according to claim 5, wherein the fixed rail is fixed to a fixing frame installed on the sidewall of the storage chamber; and the moving rail is coupled with a moving rail mounting part provided on the second side of the shelf.

7. The refrigerator according to claim 5, wherein:

the rollers include a plurality of rollers; and among the plurality of rollers, the rearmost roller is disposed at a position separated from a rear end of the cover by a distance of ⅓ or more of a length of the cover in forward and backward directions.

8. The refrigerator according to claim 5, wherein a front end of the shelf protrudes more forward than a front end of the cover and extends downward so as to cover a front surface of the cover.

9. A refrigerator comprising:

a main body;

a storage chamber provided within the main body;

drawers provided in a lower portion of the storage chamber;

a cover mounted on upper surfaces of the drawers so as to cover the upper surfaces of the drawers;

a lower shelf mounted on the cover, a first side of the lower shelf being supported so as to be pulled out by a moving rail combined with the first side of the lower shelf with a fixed rail mounted on a sidewall of the storage chamber, and a second side of the lower shelf is supported by a plurality of rollers mounted on an upper surface of the cover so as to be pulled out;

an upper shelf disposed above the lower shelf, first and second sides of the upper shelf being supported so as to be pulled out; and connection bars connecting the first side of the lower shelf and the first side of the upper shelf so that the lower shelf and the upper shelf may be simultaneously pulled out.

10. The refrigerator according to claim 9, wherein the first side of the upper shelf is supported so as to be pulled out by combining a moving rail combined with the first side of the upper shelf with a fixed rail mounted on the sidewall of the storage chamber, and the second side of the upper shelf is supported by a shelf frame mounted on a cantilever bracket mounted on a rear wall of the storage chamber so as to be pulled out.

11. The refrigerator according to claim 9, wherein both sides of the upper shelf are supported by a pair of shelf frames mounted on a pair of cantilever brackets mounted on the rear wall of the storage chamber so as to be pulled out.

12. The refrigerator according to claim 9, wherein the connection bars are detachably provided so that, if the connection bars are separated from the first sides of the lower shelf and the upper shelf, the lower shelf and the upper shelf may be independently pulled out.

13. The refrigerator according to claim 12, wherein:

upper and lower ends of the connection bars are inserted into mounting slots respectively formed on the first sides of the upper shelf and the lower shelf; and the mounting slots and contact parts of the connection bars are detachably combined by attractive force between a magnet and a metal.

* * * * *